US007952550B2

(12) United States Patent
Tanaka et al.

(10) Patent No.: US 7,952,550 B2
(45) Date of Patent: May 31, 2011

(54) LIQUID CRYSTAL DRIVER, LIQUID CRYSTAL DISPLAY DEVICE, AND LIQUID CRYSTAL DRIVING METHOD

(75) Inventors: Masami Tanaka, Kyoto (JP); Kazuyoshi Nishi, Kyoto (JP)

(73) Assignee: Panasonic Corporation, Osaka (JP)

( * ) Notice: Subject to any disclaimer, the term of this patent is extended or adjusted under 35 U.S.C. 154(b) by 911 days.

(21) Appl. No.: 11/887,648

(22) PCT Filed: Mar. 16, 2006

(86) PCT No.: PCT/JP2006/305267
§ 371 (c)(1),
(2), (4) Date: Oct. 1, 2007

(87) PCT Pub. No.: WO2006/109409
PCT Pub. Date: Oct. 19, 2006

(65) Prior Publication Data

US 2009/0289959 A1 Nov. 26, 2009

(30) Foreign Application Priority Data

Apr. 1, 2005 (JP) ..... 2005-106308

(51) Int. Cl.
*G09G 3/36* (2006.01)

(52) U.S. Cl. ..... 345/89; 345/87

(58) Field of Classification Search ..... 345/87–104, 345/690
See application file for complete search history.

(56) References Cited

U.S. PATENT DOCUMENTS

| | | | | |
|---|---|---|---|---|
| 5,243,333 | A | 9/1993 | Shiba et al. | |
| 6,107,981 | A | 8/2000 | Fujita | |
| 6,512,506 | B1 | 1/2003 | Shimada | |
| 6,661,402 | B1 | 12/2003 | Nitta et al. | |
| 6,731,263 | B2 * | 5/2004 | Goto et al. | 345/98 |
| 7,126,596 | B1 * | 10/2006 | Hogan | 345/211 |
| 7,362,304 | B2 * | 4/2008 | Takatori et al. | 345/103 |
| 2002/0033786 | A1 | 3/2002 | Akimoto et al. | |
| 2002/0039090 | A1 * | 4/2002 | Saito et al. | 345/89 |
| 2002/0186230 | A1 * | 12/2002 | Kudo et al. | 345/690 |
| 2003/0151578 | A1 | 8/2003 | Morita | |
| 2004/0017341 | A1 * | 1/2004 | Maki | 345/87 |
| 2004/0021627 | A1 * | 2/2004 | Maki | 345/89 |
| 2004/0080522 | A1 | 4/2004 | Nitta et al. | |

(Continued)

FOREIGN PATENT DOCUMENTS

CN 1437086 A 8/2003

(Continued)

OTHER PUBLICATIONS

Chinese Office Action issued in Chinese Patent Application No. 2006800110471, mailed Aug. 28, 2009.

*Primary Examiner* — Alexander Eisen
*Assistant Examiner* — Nelson Lam
(74) *Attorney, Agent, or Firm* — McDermott Will & Emery LLP

(57) ABSTRACT

A selector (103A) outputs a gray level voltage corresponding to pixel data (D-A) as drive voltage (Va). When the drive voltage (Va) is written in a source line (LineS-A), switches (105A-1, 105A-2) are ON while a switch (106A) is OFF. When the drive voltage (Va) written in the source line (LineS-A) is retained, the switches (105A-1,105A-2) are OFF while the switch (106A) is ON.

16 Claims, 12 Drawing Sheets

U.S. PATENT DOCUMENTS

| | | | | |
|---|---|---|---|---|
| 2005/0068286 | A1* | 3/2005 | Morita | 345/100 |
| 2005/0122300 | A1* | 6/2005 | Makuuchi et al. | 345/95 |
| 2005/0140630 | A1* | 6/2005 | Kikuchi et al. | 345/89 |
| 2005/0162370 | A1* | 7/2005 | Miyazaki | 345/98 |

FOREIGN PATENT DOCUMENTS

| | | |
|---|---|---|
| JP | 54-5399 | 1/1979 |
| JP | 5-35211 | 2/1993 |
| JP | 9-127918 | 5/1997 |
| JP | 3281298 | 4/1999 |
| JP | 2001-125546 | 5/2001 |
| JP | 2002-314421 | 10/2002 |
| JP | 2002-318566 | 10/2002 |
| JP | 2003-233354 | 8/2003 |

* cited by examiner

LIQUID CRYSTAL DRIVER, LIQUID CRYSTAL DISPLAY DEVICE, AND LIQUID CRYSTAL DRIVING METHOD

RELATED APPLICATIONS

This application is the U.S. National Phase under 35 U.S.C. §371 of International Application No. PCT/JP2006/305267, filed on Mar. 16, 2006, which in turn claims the benefit of Japanese Application No. 2005-106308, filed on Apr. 01, 2005, the disclosures of which Applications are incorporated by reference herein.

TECHNICAL FIELD

The present invention relates to a device for driving a liquid crystal display panel, a liquid crystal display device, and a liquid crystal driving method.

BACKGROUND ART

In recent years, liquid crystal display devices which employ a liquid crystal panel as a display device have achieved phenomenal breakthroughs. Some liquid crystal display devices possess valuable features, such as small size and light weight, and have been widely used in various portable terminals and the like (see, for example, Japanese Patent No. 3281298).

Conventional Liquid Crystal Driver 82

The structure of a liquid crystal driver 82 included in a conventional liquid crystal display device is shown in FIG. 10. The liquid crystal driver 82 generates drive voltages Va, Vb and Vc according to pixel data (display data for one pixel) D-A, D-B, D-C included in display data DATA (display data for one horizontal line) and supplies the generated drive voltage Va, Vb and Vc to source lines LineS-A, LineS-B, LineS-C, respectively. Accordingly, an image based on display data DATA is reproduced on a liquid crystal display panel 80.

The liquid crystal display panel 80 includes the source lines LineS-A, LineS-B, LineS-C, gate lines LineG-1, LineG-2, LineG-3, and pixel cells PA1 to PA3, PB1 to PB3, and PC1 to PC3. Each of the pixel cells PA1 to PA3, PB1 to PB3, and PC1 to PC3 includes a switching element TT and a liquid crystal element LC. For example, in the pixel cell PA1, the switching element TT is connected between a corresponding source line (source line LineS-A) and the liquid crystal element LC. The gate of the switching element TT is connected to a corresponding gate line (gate line LineG-1).

The internal structure of the liquid crystal driver 82 shown in FIG. 10 is now described. The driver 82 includes selectors (selectors 803A, 803B and 803C), operational amplifiers (operational amplifiers 804A, 804B and 804C), and switches (switches 805A, 805B and 805C), which are equal in number to the source lines included in the liquid crystal display panel 80 (herein, three source lines). The driver 82 further includes a gray level voltage generator 802 for generating N gray level voltages (N is a natural number).

Next, the operation of the liquid crystal driver 82 shown in FIG. 10 is described with reference to FIG. 11.

Between time t80 and time t81 is a vertical blanking interval, during which switches 805A to 805C are off. Each of the gate lines LineG-1, LineG-2, LineG-3 is supplied with OFF-voltage.

At time t81, a predetermined voltage (scan signal) is supplied to the gate line LineG-1 so that the switching elements TT of the pixel cells PA1, PB1 and PC1 are turned on. The selector 803A selects any one of the N gray level voltages (N is a natural number) generated by the gray level voltage generator 802 according to pixel data D-A included in externally-supplied display data DATA and outputs the selected gray level voltage as drive voltage Va to the operational amplifier 804A. In the same fashion, the selector 803B (803C) selects any one of the N gray level voltages (N is a natural number) generated by the gray level voltage generator 802 according to pixel data D-B (D-C) included in externally-supplied display data DATA and outputs the selected gray level voltage as drive voltage Vb (Vc) to the operational amplifier 804B (804C).

The operational amplifier 804A amplifies drive voltage Va output from the selector 803A and outputs amplified drive voltage Va to the switch 805A. In the same fashion, the operational amplifier 804B (804C) amplifies drive voltage Vb (Vc) output from the selector 803B (803C) and outputs amplified drive voltage Vb (Vc) to the switch 805B (805C). Each of the switches 805A, 805B and 805C is turned on at time t81. Accordingly, the source line LineS-A (LineS-B, LineS-C) is charged/discharged till the voltage value of drive voltage Va (Vb, Vc) is reached (i.e., drive voltage Va (Vb, Vc) is written in the source line LineS-A (LineS-B, LineS-C)).

Then, during a horizontal blanking interval, the predetermined voltage (scan signal) is not supplied to the gate line LineG-1 so that the switching elements TT of the pixel cells PA1, PB1 and PC1 are off. As a result, the voltages of the source lines LineS-A, LineS-B and LineS-C (drive voltages Va, Vb and Vc) are retained in the pixel cells PA1, PB1 and PC1. Then, each of the switches 805A, 805B and 805C is turned off.

Then, at time t82 (after display data DATA for one subsequent horizontal line has been input), a scan signal is supplied to the gate line LineG-2 so that the switching elements TT of pixel cells PA2, PB2 and PC2 are turned on. Then, in the liquid crystal driver 82, the same operation as that carried out at time t81 is performed.

In such a way, drive voltages Va, Vb and Vc corresponding to pixel data D-A, D-B, D-C are written in respective one of the pixel cells PA1 to PA3, PB1 to PB3 and PC1 to PC3 of the liquid crystal display panel 80.

In recent years, meanwhile, demands for higher definition and higher image quality in liquid crystal display panels have been increasing. Meeting such demands in the conventional liquid crystal driver 82 shown in FIG. 10 entails a gross circuit scale of the liquid crystal driver because of an increased number of source lines included in the liquid crystal display panel 80.

For such a disadvantage, a liquid crystal display panel 90 and liquid crystal driver 92 as shown in FIG. 12 have conventionally been proposed (see, for example, Japanese Laid-Open Patent Publication No. 2002-318566).

Conventional Liquid Crystal Driver 92

The liquid crystal display panel 90 shown in FIG. 12 includes switches 905A, 905B and 905C in addition to the components of the liquid crystal display panel 80 shown in FIG. 10. The liquid crystal driver 92 shown in FIG. 12 includes a gray level voltage generator 902, a selector 903, and an operational amplifier 904. The selector 903 receives display data DATA from an external device to sequentially select the gray level voltage corresponding to pixel data D-A, the gray level voltage corresponding to pixel data D-B, and the gray level voltage corresponding to pixel data D-C in this order. The selector 903 outputs the gray level voltage corresponding to pixel data D-A as drive voltage Va, the gray level voltage corresponding to pixel data D-B as drive voltage Vb, and the gray level voltage corresponding to pixel data D-C as drive voltage Vc.

When the selector 903 selects the gray level voltage corresponding to pixel data D-A, the switch 905A of the liquid crystal display panel 90 is turned on. When the selector 903 selects the gray level voltage corresponding to pixel data D-B, the switch 905B is turned on. When the selector 903 selects the gray level voltage corresponding to pixel data D-C, the switch 905C is turned on.

Next, the operation of the liquid crystal driver 92 and switches 905A, 905B and 905C shown in FIG. 12 is described.

First, the selector 903 receives display data DATA from an external device. At this point in time, a predetermined voltage (scan signal) is supplied to the gate line LineG-1 so that the switching elements TT of the pixel cells PA1, PB1 and PC1 are turned on.

Then, the selector 903 selects the gray level voltage corresponding to pixel data D-A included in display data DATA. Meanwhile, the switch 905A is turned on. As a result, drive voltage Va output from the selector 903 is supplied to the source line LineS-A via the operational amplifier 904.

Then, the selector 903 selects the gray level voltage corresponding to pixel data D-B included in display data DATA. Meanwhile, the switch 905B is turned on while the switch 905A is turned off. As a result, the source line LineS-A is disconnected from the operational amplifier 904 (writing of the drive voltage in the source line LineS-A is completed). Drive voltage Vb output from the selector 903 is supplied to the source line LineS-B via the operational amplifier 904.

Then, the selector 903 selects the gray level voltage corresponding to pixel data D-C included in display data DATA. Meanwhile, the switch 905C is turned on while the switch 905B is turned off. As a result, the source line LineS-B is disconnected from the operational amplifier 904 (writing of the drive voltage in the source line LineS-B is completed). Drive voltage Vc output from the selector 903 is supplied to the source line LineS-C via the operational amplifier 904.

Then, for example, during a blanking interval, the predetermined voltage (scan signal) is not supplied to the gate line LineG-1 so that the switching elements TT of the pixel cells PA1, PB1 and PC1 are off. As a result, the voltages at the source lines LineS-A, LineS-B and LineS-C (drive voltages Va, Vb and Vc) are written in the pixel cells PA1, PB1 and PC1. The switch 905C is turned off. Therefore, the source line LineS-C is disconnected from the operational amplifier 904.

Then, display data DATA of a subsequent horizontal line is input. Accordingly, a scan signal is supplied to the gate line LineG-2 so that the switching elements TT of the pixel cells PA2, PB2 and PC2 are turned on. Then, the liquid crystal driver 92 carries out the same operation as that described above.

In such a way, the operational amplifier 904 is sequentially allocated to the source lines LineS-A, LineS-B and LineS-C such that writing of drive voltages in a plurality of source lines (herein, three source lines LineS-A, LineS-B and LineS-C) is realized by the single operational amplifier 904. With this feature, the circuit scale of the liquid crystal driver is decreased.

Patent Document 1: Japanese Patent No. 3281298

Patent Document 2: Japanese Laid-Open Patent Publication No. 2002-318566.

DISCLOSURE OF INVENTION

Problems to be Solved by the Invention

However, there is a possibility that the voltage on a source line of the liquid crystal display panel is affected by a leak current in the switching element TT or a parasitic capacitance of the source line to disadvantageously fluctuate. For example, as the leak current in the switching element TT increases, the fluctuations in voltage on the source line become larger. In the liquid crystal display panel 80 shown in FIG. 10, drive voltage Va is supplied to the source line LineS-A via the operational amplifier 804A till the voltage on the source line LineS-A is retained in the pixel cell PA1. Therefore, the fluctuations in voltage on the source line LineS-A are suppressed. However, in the liquid crystal display panel 90 shown in FIG. 12, the source line LineS-A is disconnected from the operational amplifier 904A after completion of writing of drive voltage Va in the source line LineS-A, so that drive voltage Va is not supplied (the source line LineS-A reaches a high impedance state). Therefore, the fluctuations in voltage on the source line LineS-A prominently emerge. When a fluctuation occurs in the voltage on the source line LineS-A, the voltage written in a liquid crystal element LC fluctuates, so that the display quality of images reproduced on the liquid crystal display panel 90 deteriorates. The same phenomenon occurs also in the source lines LineS-B and LineS-C.

In general, the switching element TT of the liquid crystal display panel is formed by an amorphous TFT (Thin Film Transistor). However, the amorphous TFT provides a relatively large leak current, and therefore, in the case where the switching element TT of the liquid crystal display panel 90 shown in FIG. 12 or the switching element of the liquid crystal display panel disclosed in Japanese Laid-Open Patent Publication No. 2002-318566 is formed by an amorphous TFT, the effects of the leak current of the amorphous TFT cannot be neglected. A conceivable solution for suppressing such fluctuations in voltage on the source line is using a switching element with a small leak current (e.g., polysilicon TFT). However, the polysilicon TFT requires greater production cost than the amorphous TFT.

An objective of the present invention is to provide a liquid crystal driver and liquid crystal display device wherein the circuit scale is decreased while fluctuations in voltage on the source line are suppressed.

Means for Solving the Problems

According to one aspect of the present invention, a liquid crystal driver drives a liquid crystal display panel which includes P source lines (P is a natural number). The liquid crystal driver includes a gray level voltage generator, an operational amplifier, P selectors and P connection switching sections. The gray level voltage generator generates N gray level voltages which have different voltage values from one another (N is a natural number). The operational amplifier amplifies an input voltage. The P selectors correspond to the P source lines. The P connection switching sections correspond to the P selectors. Each of the P selectors receives pixel data indicative of a gray level to select one of the N gray level voltages generated by the gray level voltage generator which corresponds to the pixel data and outputs the selected gray level voltage. Each of the P connection switching sections has a voltage write mode and a voltage retention mode. In the voltage write mode, each of the connection switching sections supplies an output of a corresponding one of the P selectors to the operational amplifier and supplies an output of the operational amplifier to a corresponding one of the P source lines. In the voltage retention mode, each of the connection switching sections supplies an output of a corresponding one of the P selectors to a corresponding one of the P source lines.

In the above-described liquid crystal driver, a gray level voltage from a selector is supplied to a source line via an operational amplifier, so that writing of the gray level voltage in the source line (charging/discharging of the source line) is quickly carried out. The source line is supplied with the gray level voltage from the selector, so that fluctuations in voltage on the source line are suppressed. As compared with the prior art, the number of operational amplifiers is small so that the circuit scale of the liquid crystal driver is decreased.

Preferably, each of the P connection switching sections includes a first switch, a second switch and a third switch. The first switch is connected between one of the P selectors corresponding to the connection switching section and the operational amplifier. The second switch is connected between one of the P source lines corresponding to the connection switching section and the operational amplifier. The third switch is connected between one of the P selectors corresponding to the connection switching section and one of the P source lines corresponding to the connection switching section. In the voltage write mode, the first and second switches are ON while the third switch is OFF. In the voltage retention mode, the first and second switches are OFF while the third switch is ON.

Preferably, the above-described liquid crystal driver further includes a controller for controlling the P connection switching sections. The controller sets any one of the P connection switching sections into the voltage write mode. After passage of a first predetermined interval, the controller shifts the connection switching section from the voltage write mode to the voltage retention mode.

In the above-described liquid crystal driver, the gray level voltage from the selector is supplied to the source line via the operational amplifier till the voltage value of the voltage on the source line reaches the voltage value of the gray level voltage. After the voltage value of the voltage on the source line has reached the voltage value of the gray level voltage, the source line is supplied with the drive voltage from the selector. With this feature, writing of the gray level voltage in the source line is quickly carried out, and fluctuations in voltage on the source line are suppressed.

Preferably, the controller sets each of the P connection switching sections into the voltage write mode at least once.

In the above-described liquid crystal driver, writing of the drive voltages using the operational amplifier is carried out on all of the source lines.

Preferably, after the mode shift in each of the P connection switching sections is completed, the controller keeps all of the P connection switching sections in the voltage retention mode till a second predetermined interval is passed.

In the above-described liquid crystal driver, after writing of the gray level voltages in all of the source lines has been completed, all of the connection switching sections are in the voltage retention mode till the second predetermined interval is passed. With this feature, the effects of fluctuations in current characteristics of the operational amplifier are suppressed.

Preferably, the controller carries out the mode shift in each of the P connection switching sections more than once during the second predetermined interval.

In the above-described liquid crystal driver, for example, writing of a gray level voltage in a source line is carried out in separate cycles within one horizontal line interval. Therefore, in the respective source lines, the times of completion of writing of the gray level voltages are substantially identical. Thus, fluctuations in voltages on the respective source lines are uniform.

Preferably, the above-described liquid crystal driver further includes a power controller. If any one of the P connection switching sections is in the voltage write mode, the power controller supplies power to the operational amplifier. If all of the P connection switching sections are in the voltage retention mode, the power controller interrupts supply of power to the operational amplifier.

In the above-described liquid crystal driver, the operational amplifier is driven when the operational amplifier is used. However, when the operational amplifier is not used, the operational amplifier is halted. With this feature, the power consumption by the operational amplifier is decreased.

Preferably, the gray level voltage generator includes a ladder resistor and N amplification operational amplifiers. The ladder resistor is connected between a first reference node and a second reference node and includes N taps. The N amplification operational amplifiers correspond to the N taps of the ladder resistor. Each of the N amplification operational amplifiers is connected between a corresponding one of the N taps and each of the P selectors.

In the above-described liquid crystal driver, each of the N operational amplifiers amplifies one of the N gray level voltages generated by the ladder resistor which corresponds to the operational amplifier (the impedance of the gray level voltage decreases). With this feature, fluctuations in voltage on the source line are further suppressed. Also, the effects of fluctuations in current characteristics of the operational amplifier are further suppressed.

Preferably, the gray level voltage generator includes a first ladder resistor, a second ladder resistor and a ladder resistor connector. The first ladder resistor is connected between a first reference node and a second reference node and includes N first taps. The second ladder resistor is connected between a third reference node and a fourth reference node and includes N second taps. If all of the P connection switching sections are in the voltage retention mode, the ladder resistor connector connects the N first taps of the first ladder resistor and the N second taps of the second ladder resistor on a one-to-one basis.

In the above-described liquid crystal driver, the N first taps of the first ladder resistor generates N gray level voltages. After writing of the gray level voltages in all of the source lines is completed, the ladder resistor connector connects the N first taps of the first ladder resistor and the N second taps of the second ladder resistor. When the N first taps of the first ladder resistor and the N second taps of the second ladder resistor are connected, the current flowing through each of the N first taps becomes larger. Thus, fluctuations in voltage on the source line are further suppressed. Also, the effects of fluctuations in current characteristics of the operational amplifier are further suppressed.

Preferably, the gray level voltage generator further includes a power controller. If any one of the P connection switching sections is in the voltage write mode, the power controller supplies power to the second ladder resistor. If all of the P connection switching sections are in the voltage retention mode, the power controller interrupts supply of the power to the second ladder resistor.

In the above-described liquid crystal driver, the second ladder resistor is supplied with power when the second ladder resistor is used. However, when the second ladder resistor is not used, the supply of power to the second ladder resistor is stopped. With this feature, the power consumption by the ladder resistor is decreased.

Preferably, a liquid crystal display device includes the above-described liquid crystal driver, a liquid crystal display panel and a gate driver. The liquid crystal display panel includes the P source lines, Q gate lines (Q is a natural number), and P×Q pixel cells. The gate driver drives the Q gate lines. Each of the P×Q pixel cells includes a switching element and a liquid crystal element.

In the above-described liquid crystal display device, writing of a gray level voltage in a source line of the liquid crystal display panel is quickly carried out. Accordingly, switching of images displayed on the liquid crystal display panel is quickly carried out. Also, fluctuations in voltage on the source line of the liquid crystal display panel are suppressed. Thus, the display quality of images reproduced on the liquid crystal display panel is improved. Also, the circuit scale of the liquid crystal display device is decreased.

According to another aspect of the present invention, a liquid crystal driver drives a liquid crystal display panel which includes P source lines (P is a natural number). The liquid crystal driver includes a gray level voltage generator, an operational amplifier, P selectors, P first switches, P second switches, and P third switches. The gray level voltage generator generates N gray level voltages which have different voltage values from one another (N is a natural number). The operational amplifier amplifies an input voltage. The P selectors correspond to the P source lines. The P first switches correspond to the P selectors. The P second switches correspond to the P source lines. The P third switches correspond to the P selectors. Each of the P selectors receives pixel data indicative of a gray level to select one of the N gray level voltages generated by the gray level voltage generator which corresponds to the pixel data and outputs the selected gray level voltage. Each of the P first switches is connected between a corresponding one of the P selectors and the operational amplifier. Each of the P second switches is connected between a corresponding one of the P source lines and the operational amplifier. Each of the P third switches is connected between a corresponding one of the P selectors and a corresponding one of the P source lines.

In the above-described liquid crystal driver, any one of the P first switches is turned on and a second switch corresponding to the turned-on first switch is also turned on while a third switch corresponding to the turned-on first switch is turned off, whereby a gray level voltage from a selector (a gray level voltage from a selector corresponding to the turned-on first switch) is quickly written in a source line corresponding to the turned-on first switch. Also, when the first and second switches are off while the third switch is on, the gray level voltage from the selector is supplied to the source line via the third switch. With this feature, fluctuations in voltage on the source line are suppressed.

According to still another aspect of the present invention, a liquid crystal driving method is a method for driving a liquid crystal display panel which includes P source lines (P is a natural number). The method includes step (A), step (B), step (C) and step (D). At step (A), N gray level voltages which have different voltage values from one another (N is a natural number) are generated. At step (B), pixel data is externally received, and one of the N gray level voltages generated at step (A) which corresponds to the pixel data is selected. At step (C), the gray level voltage selected at step (B) is amplified, and the amplified gray level voltage is supplied to any one of the P source lines. At step (D), after step (C), the gray level voltage selected at step (B) is supplied to the source line.

In the above-described liquid crystal driving method, after writing of the gray level voltage in the source line is completed, the gray level voltage from the selector is supplied to the source line. With this feature, fluctuations in voltage on the source line are suppressed.

EFFECTS OF THE INVENTION

As described above, writing of a gray level voltage in a source line (charging/discharging of the source line) is quickly carried out. Also, fluctuations in voltage on the source line are suppressed. Further, the circuit scale of the liquid crystal driver is decreased.

Figure 1:
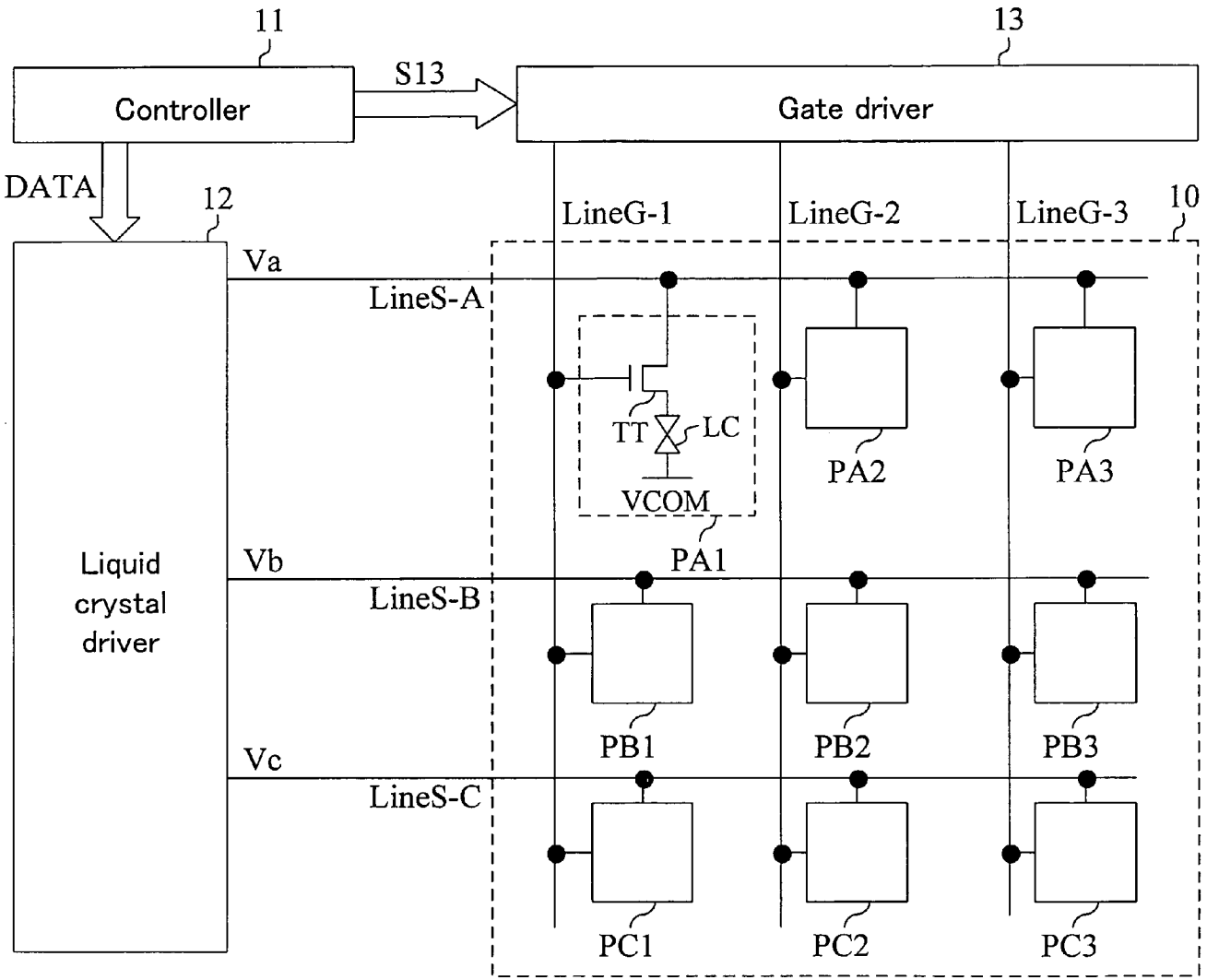
FIG. 1 shows a general structure of a liquid crystal display device according to embodiment 1 of the present invention.

DESCRIPTION OF REFERENCE NUMERALS (10) Liquid crystal panel
(11) Controller
(12) Liquid crystal driver
(13) Gate driver
(LineS-A, LineS-B, LineS-C) Source lines
(LineG-1, LineG-2, LineG-3) Gate lines
(PA1 to PA3, PB1 to PB3, PC1 to PC3) Pixel cells
(TT) Switching element
(LC) Liquid crystal element
(VCOM) Counter electrode
(101,201) Switch controllers
(102, 402, 502) Gray level voltage generators
(103A, 103B, 103C) Selectors
(104) Operational amplifier
(105A-1, 105A-2, 105B-1, 105B-2, 105C-1, 105C-2) Op-amp switches
(106A, 106B, 106C) Voltage retention switches
(202, 512) Power supply switches (R411-1 to R411-4, R511-1 to R511-4) Resistors
(412-1 to 412-4) Operational amplifiers
(513-1 to 513-4) Connection switches

BEST MODE FOR CARRYING OUT THE INVENTION

Hereinafter, embodiments of the present invention are described in detail with reference to the drawings. It should be noted that identical or equivalent elements are denoted by identical reference numerals throughout the drawings, and the descriptions thereof are not repeated.

Embodiment 1

Structure

FIG. 1 shows a general structure of a liquid crystal display device according to embodiment 1 of the present invention. This device sequentially receives a plurality of pieces of display data DATA (display data for one horizontal line) and reproduces images according to display data DATA on a liquid crystal display panel 10.

This device includes the liquid crystal display panel 10, a controller 11, a liquid crystal driver 12, and a gate driver 13.

The liquid crystal display panel 10 includes source lines LineS-A, LineS-B and LineS-C, gate lines LineG-1, LineG-2 and LineG-3, and pixel cells PA1 to PA3, PB1 to PB3, and PC1 to PC3 arranged in a matrix format. Each of the pixel cells PA1 to PA3, PB1 to PB3, and PC1 to PC3 includes a switching element TT and a liquid crystal element LC. In the pixel cell PA1, the switching element IT is connected between a corresponding source line (source line LineS-A) and the liquid crystal element LC. The gate of the switching element IT is connected to a corresponding gate line (gate line LineG-1). The liquid crystal element LC is connected between the switching element TT and a counter electrode VCOM. The other pixel cells PA2, PA3, PB1 to PB3, and PC1 to PC3 have the same structure as the pixel cell PA1.

The controller 11 outputs display data DATA to the liquid crystal driver 12. The controller 11 also outputs scan control signal S13 to the gate driver 13. Display data DATA is data for one horizontal line, which includes a plurality of pieces of pixel data D-A, D-B and D-C. Pixel data D-A, D-B and D-C each represent the voltage level of a drive voltage which is to be written in a corresponding pixel cell.

The liquid crystal driver 12 supplies, to the source lines LineS-A, LineS-B and LineS-C, drive voltages Va, Vb and Vc according to pixel data D-A, D-B and D-C included in display data DATA output from the controller 11. Drive voltages Va, Vb and Vc represent the voltage values corresponding to display data D-A, D-B and D-C, respectively.

The gate driver 13 outputs a scan signal to any one of the gate lines LineG-1, LineG-2 and LineG-3 according to scan control signal S13 output from the controller 11. The scan signal is a voltage which turns on (activates) the switching element TT included in each of the pixel cells PA1 to PC3.

Internal Structure of Liquid Crystal Driver

Figure 2:
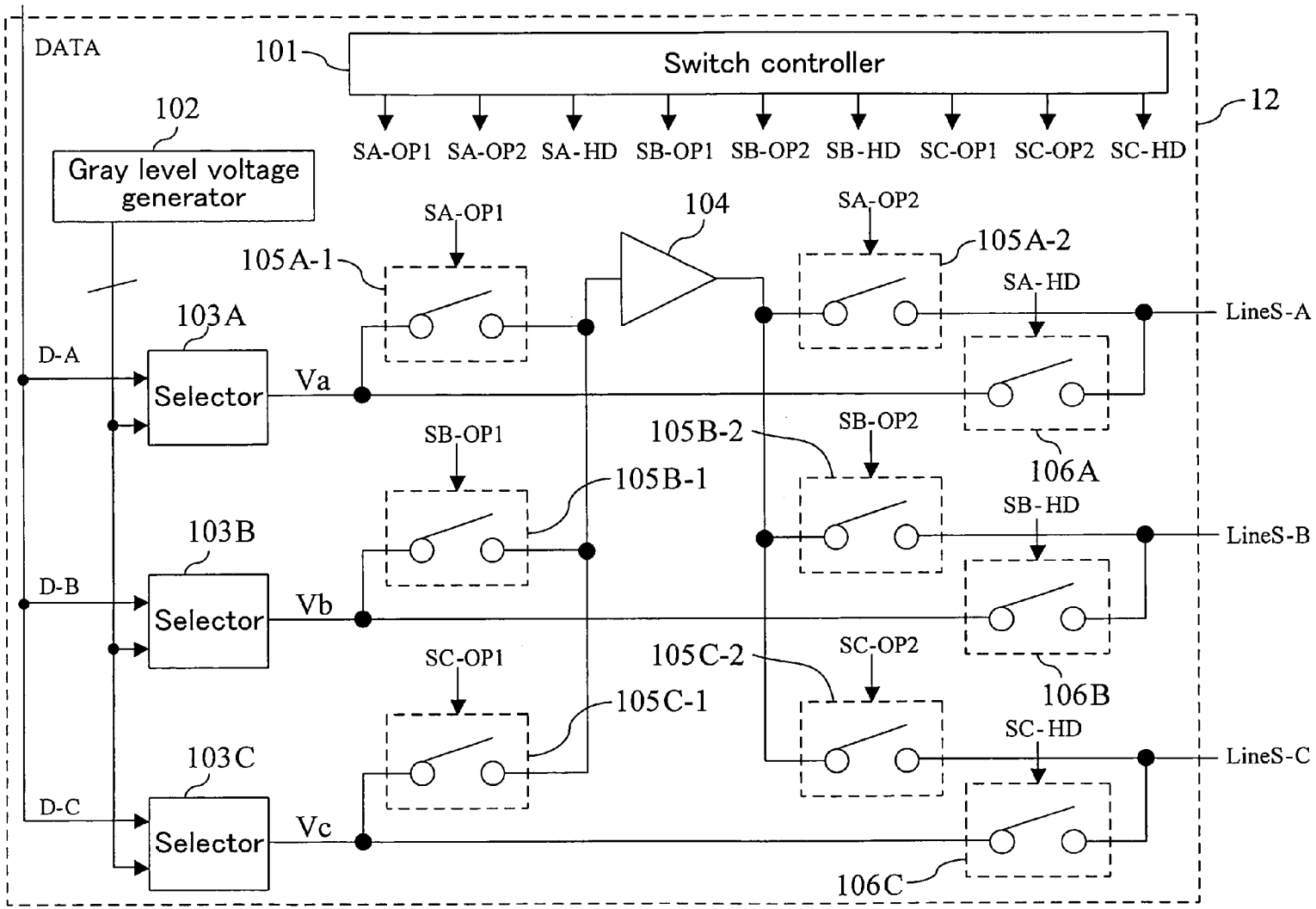
FIG. 2 shows an internal structure of the liquid crystal driver shown in FIG. 1.

FIG. 2 shows the internal structure of the liquid crystal driver 12 shown in FIG. 1. The liquid crystal driver 12 includes a switch controller 101, a gray level voltage generator 102, selectors 103A, 103B and 103C, an operational amplifier 104, switches for the operational amplifier ("op-amp switches") 105A-1, 105A-2, 105B-1, 105B-2, 105C-1 and 105C-2, and switches for voltage retention ("voltage retention switches") 106A, 106B and 106C.

The switch controller 101 outputs control signals SA-OP1, SA-OP2, SA-HD, SB-OP1, SB-OP2, SB-HD, SC-OP1, SC-OP2, and SC-HD according to predetermined timings.

The gray level voltage generator 102 generates N gray level voltages (N is a natural number). The N gray level voltages have different voltage values from one another.

The selector 103A receives pixel data D-A of display data DATA output from the controller 11 (FIG. 1). The selector 103A selects one of the N gray level voltages generated by the gray level voltage generator 102 corresponding to received pixel data D-A and outputs the selected gray level voltage as drive voltage Va. The selector 103B (103C) also receives, as the selector 103A does, pixel data D-B (D-C) output from the controller 11 and selects one of the N gray level voltages generated by the gray level voltage generator 102 corresponding to received pixel data D-B (D-C) to output the selected gray level voltage as drive voltage Vb (Vc).

The operational amplifier 104 is a so-called voltage follower circuit, which amplifies a voltage input thereto.

The op-amp switch 105A-1 is connected between the selector 103A and the operational amplifier 104 and receives control signal SA-OP1. The op-amp switch 105B-1 is connected between the selector 103B and the operational amplifier 104 and receives control signal SB-OP1. The op-amp switch 105C-1 is connected between the selector 103C and the operational amplifier 104 and receives control signal SC-OP1. The op-amp switches 105A-1, 105B-1 and 105C-1 are ON when control signals SA-OP1, SB-OP1 and SC-OP1 output from the switch controller 101 are "H-level" but OFF when control signals SA-OP1, SB-OP1 and SC-OP1 are "L-level".

The op-amp switch 105A-2 is connected between the operational amplifier 104 and the source line LineS-A and receives control signal SA-OP2. The op-amp switch 105B-2 is connected between the operational amplifier 104 and the source line LineS-B and receives control signal SB-OP2. The op-amp switch 105C-2 is connected between the operational amplifier 104 and the source line LineS-C and receives control signal SC-OP2. The op-amp switches 105A-2, 105B-2 and 105C-2 are ON when control signals SA-OP2, SB-OP2 and SC-OP2 output from the switch controller 101 are "H-level" but OFF when control signals SA-OP2, SB-OP2 and SC-OP2 are "L-level".

The voltage retention switch 106A is connected between the selector 103A and the source line LineS-A and receives control signal SA-HD. The voltage retention switch 106B is connected between the selector 103B and the source line LineS-B and receives control signal SB-HD. The voltage retention switch 106C is connected between the selector 103C and the source line LineS-C and receives control signal SC-HD. The voltage retention switches 106A, 106B and 106C are ON when control signals SA-HD, SB-HD and SC-HD output from the switch controller 101 are "H-level" but OFF when control signals SA-HD, SB-HD and SC-HD are "L-level".

Operation of Liquid Crystal Display Device

Next, the operation of the liquid crystal display device shown in FIG. 1 is described.

First, the controller 11 outputs scan control signal S13 to the gate driver 13. When receiving scan control signal S13 from the controller 11, the gate driver 13 outputs a scan signal to the gate line LineG-1 of the liquid crystal display panel 10.

As a result, the switching elements TT included in the pixel cells PA1, PB1 and PC1 connected to the gate line LineG-1 are activated (i.e., turned on).

Meanwhile, the controller 11 outputs display data DATA to the liquid crystal driver 12. When receiving display data DATA from the controller 11, the liquid crystal driver 12 supplies drive voltage Va corresponding to pixel data D-A included in display data DATA to the source line LineS-A, drive voltage Vb corresponding to pixel data D-B included in display data DATA to the source line LineS-B, and drive voltage Vc corresponding to pixel data D-C included in display data DATA to the source line LineS-C. As a result, drive voltage Va is written in the source line LineS-A, drive voltage Vb is written in the source line LineS-B, and drive voltage Vc is written in the source line LineS-C.

Then, after writing of drive voltage Va (Vb, Vc) in the source line LineS-A (LineS-B, LineS-C) is completed, the controller 11 outputs scan control signal S13 to the gate driver 13. When receiving scan control signal S13 from the controller 11, the gate driver 13 stops outputting the scan signal to the gate line LineG-1 of the liquid crystal display panel 10. As a result, voltage $V_{LineS-A}$ of the source line LineS-A is retained in the pixel cell PA1. Also, voltage $V_{LineS-B}$ ($V_{LineS-C}$) of the source line LineS-B (LineS-C) is retained in the pixel cell PB1 (PC1) as in the pixel cell PA1. When receiving scan control signal S13 from the controller 11, the gate driver 13 outputs a scan signal to the gate line LineG-2 of the liquid crystal display panel 10. Meanwhile, the controller 11 outputs display data DATA (display data for a subsequent horizontal line) to the liquid crystal driver 12.

In such a way, drive voltage Va, Vb and Vc output from the selectors 103A, 103B and 103C are retained in the respective pixel cells in the order of the first horizontal line (the pixel cell PA1, PB1 and PC1), the second horizontal line (the pixel cell PA2, PB2 and PC2), and the third horizontal line (the pixel cell PA3, PB3 and PC3).

Operation of Liquid Crystal Driver

Figure 3:
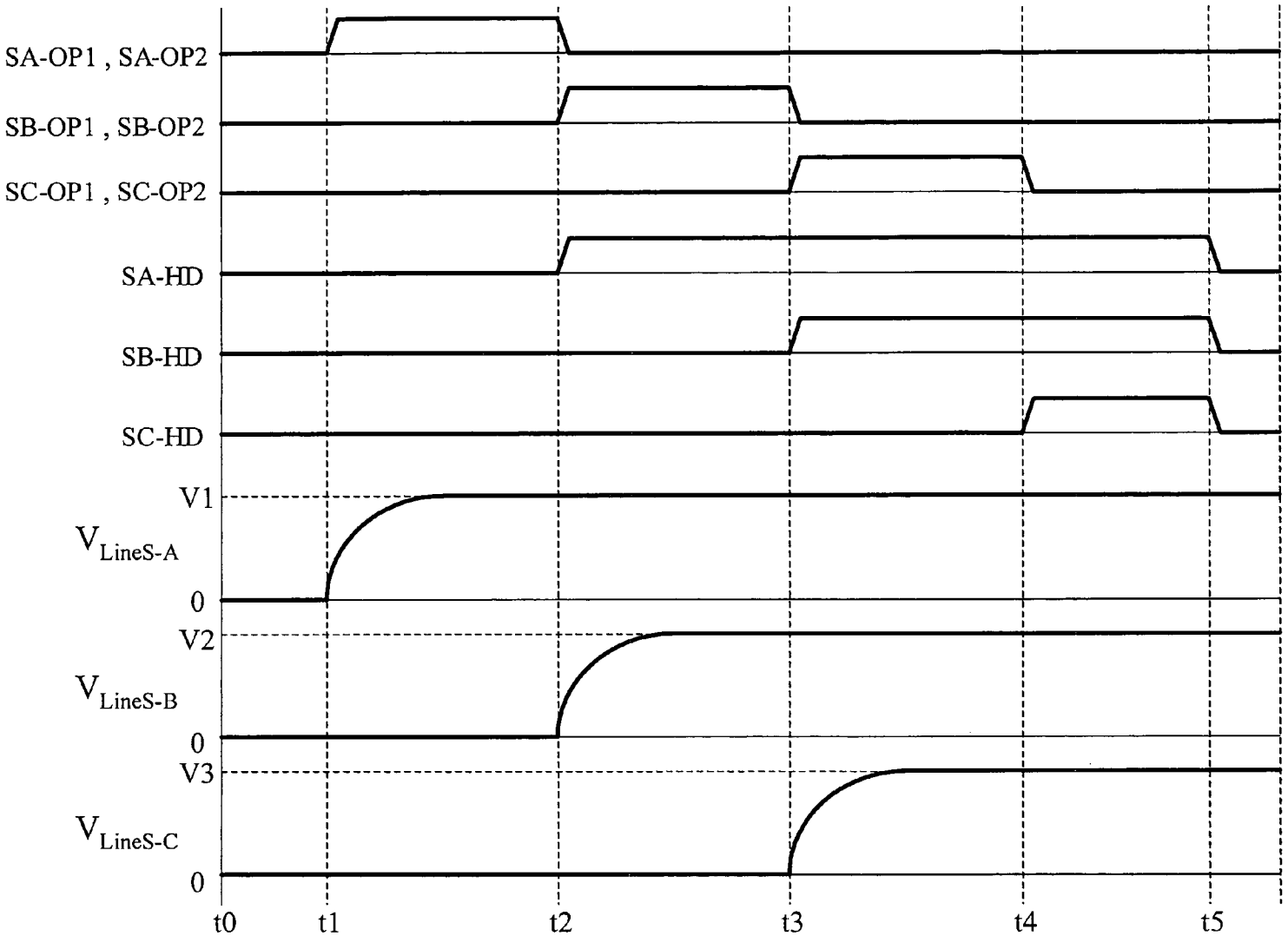
FIG. 3 is a timing chart which illustrates the operation of a liquid crystal driver shown in FIG. 2.

Next, the operation of the liquid crystal driver 12 shown in FIG. 2 is described with reference to FIG. 3.

At time t1, the gate driver 13 outputs a scan signal to the gate line LineG-1. The selector 103A (103B, 103C) receives pixel data D-A (D-B, D-C) from the controller 11 and outputs one of the N gray level voltages generated by the gray level voltage generator 102 corresponding to received pixel data D-A (D-B, D-C).

The switch controller 101 sets control signals SA-OP1 and SA-OP2 to "H-level", whereby the source line LineS-A is connected to the selector 103A via the operational amplifier 104. The operational amplifier 104 amplifies drive voltage Va output from the selector 103A. Drive voltage Va amplified by the operational amplifier 104 is supplied to the source line LineS-A. Then, the voltage value of voltage $V_{LineS-A}$ on the source line LineS-A becomes equal to voltage value V1 of drive voltage Va (writing of drive voltage Va in the source line LineS-A is completed).

At time t2, the switch controller 101 sets control signals SA-OP1 and SA-OP2 to "L-level" and control signal SA-HD to "H-level". Accordingly, drive voltage Va output from the selector 103A is supplied to the source line LineS-A via the voltage retention switch 106A. Therefore, voltage $V_{LineS-A}$ on the source line LineS-A is maintained equal to voltage value V1 of drive voltage Va as shown in FIG. 3.

Meanwhile, the switch controller 101 sets control signals SB-OP1 and SB-OP2 to "H-level". Accordingly, the source line LineS-B is connected to the selector 103B via the operational amplifier 104. The operational amplifier 104 amplifies drive voltage Vb output from the selector 103B. Drive voltage Vb amplified by the operational amplifier 104 is supplied to the source line LineS-B. Then, the voltage value of voltage $V_{LineS-B}$ on the source line LineS-B becomes equal to voltage value V2 of drive voltage Vb (writing of drive voltage Vb in the source line LineS-B is completed).

At time t3, the switch controller 101 sets control signals SB-OP1 and SB-OP2 to "L-level" and control signal SB-HD to "H-level". Accordingly, drive voltage Vb output from the selector 103B is supplied to the source line LineS-B via the voltage retention switch 106B. Therefore, voltage $V_{LineS-B}$ on the source line LineS-B is maintained equal to voltage value V2 of drive voltage Vb as shown in FIG. 3.

Meanwhile, the switch controller 101 sets control signals SC-OP1 and SC-OP2 to "H-level". Accordingly, drive voltage Vc output from the selector 103C is supplied to the source line LineS-C via the operational amplifier 104. Then, the voltage value of voltage $V_{LineS-C}$ on the source line LineS-C becomes equal to voltage value V3 of drive voltage Vc (writing of drive voltage Vc in the source line LineS-C is completed). Thus, writing of the drive voltages in all of the source lines LineS-A, LineS-B and LineS-C is completed.

At time t4, the switch controller 101 sets control signals SC-OP1 and SC-OP2 to "L-level" and control signal SC-HD to "H-level". Accordingly, drive voltage Vc output from the selector 103C is supplied to the source line LineS-C via the voltage retention switch 106C. Therefore, voltage $V_{LineS-C}$ on the source line LineS-C is maintained equal to voltage value V3 of drive voltage Vc as shown in FIG. 3.

During the interval between time t4 and time t5, the switch controller 101 sets control signals SA-HD, SB-HD and SC-HD to "H-level". During this interval, the source lines LineS-A, LineS-B and LineS-C are supplied with drive voltages Va, Vb and Vc from the corresponding selectors 103A, 103B and 103C via the voltage retention switches 106A, 106B and 106C.

At time t5, the switch controller 101 sets control signals SA-HD, SB-HD and SC-HD to "L-level". The gate driver 13 stops outputting the scan signal to the gate line LineG-1. As a result, voltage $V_{LineS-A}$ of the source line LineS-A is retained in the pixel cell PA1. Meanwhile, voltage $V_{LineS-B}$ ($V_{LineS-C}$) of the source line LineS-B (LineS-C) is retained in the pixel cell PB1 (PC1) as in the pixel cell PA1.

Thus, when drive voltage Va (Vb, Vc) is written in the source line LineS-A (LineS-B, LineS-C), drive voltage Va (Vb, Vc) output from the selector 103A (103B, 103C) is supplied to the source line LineS-A (LineS-B, LineS-C) via the operational amplifier 104. When voltage $V_{LineS-A}$ ($V_{LineS-B}$) $V_{LineS-C}$) of the source line LineS-A (LineS-B, LineS-C) is retained, drive voltage Va (Vb, Vc) output from the selector 103A (103B, 103C) is supplied to the source line LineS-A (LineS-B, LineS-C) via the voltage retention switch 106A (106B, 106C).

Effects

As described above, drive voltage Va (Vb, Vc) is supplied to the source line LineS-A (LineS-B, LineS-C) via the operational amplifier 104, such that writing of drive voltage Va (Vb, Vc) in the source line LineS-A (LineS-B, LineS-C) (charging/discharging of the source line LineS-A (LineS-B, LineS-C)) is quickly carried out. With this feature, reproduction of images on the liquid crystal display panel 10 is also quickly carried out.

After completion of writing of drive voltage Va (Vb, Vc) in the source line LineS-A (LineS-B, LineS-C), drive voltage Va (Vb, Vc) output from the selector 103A (103B, 103C) is supplied to the source line LineS-A (LineS-B, LineS-C) via the voltage retention switch 106A (106B, 106C) such that the voltage value of voltage $V_{LineS-A}$ ($V_{LineS-B}$, $V_{LineS-C}$) of the source line LineS-A (LineS-B, LineS-C) is maintained equal to the voltage value of drive voltage Va (Vb, Vc). With this feature, fluctuations in voltage on the source line LineS-A (LineS-B, LineS-C) are suppressed, and hence, the display quality of images reproduced on the liquid crystal display panel 10 is improved.

Further, the number of operational amplifiers can be reduced as compared with the conventional structure, and therefore, the circuit scale of the liquid crystal driver can be reduced.

By supplying drive voltage Va (Vb, Vc) output from the selector 103A (103B, 103C) to the source line LineS-A (LineS-B, LineS-C) via the voltage retention switch 106A (106B, 106C), the voltage value of voltage $V_{LineS-A}$ ($V_{LineS-B}$, $V_{LineS-C}$) on the source line LineS-A (LineS-B, LineS-C) converges on the voltage value of drive voltage Va (Vb, Vc). With this feature, the effects of the variations in the current characteristics of the operational amplifier 104 are suppressed. Namely, the voltage value of the source line can be converged on the voltage value of the drive voltage even when the drive voltage output from the operational amplifier 104 is not precisely identical to the drive voltage input to the operational amplifier 104 due to the variations in the current characteristics of the operational amplifier 104.

Embodiment 2

General Structure

Figure 4:
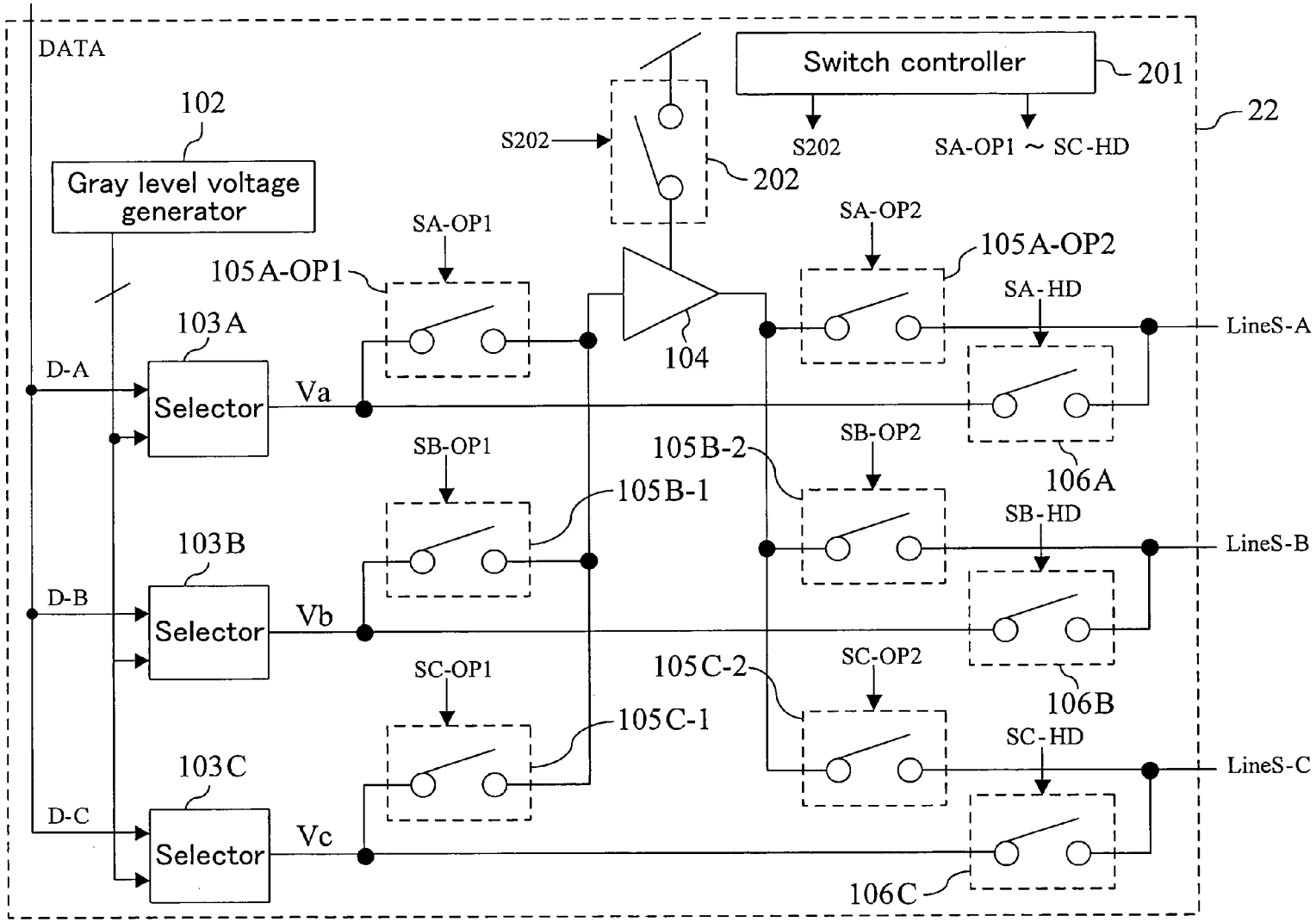
FIG. 4 shows an internal structure of a liquid crystal driver according to embodiment 2 of the present invention.

A liquid crystal display device according to embodiment 2 of the present invention includes a liquid crystal driver 22 shown in FIG. 4 in place of the liquid crystal driver 12 shown in FIG. 1. The other components are the same as those of FIG. 1.

Internal Structure of Liquid Crystal Driver

FIG. 4 shows the internal structure of the liquid crystal driver 22 of this embodiment. The liquid crystal driver 22 includes a switch controller 201 in place of the switch controller 101 shown in FIG. 2. The liquid crystal driver 22 further includes a switch for power supply (power supply switch 202). The other components are the same as those of FIG. 2. The switch controller 201 outputs control signal S202 in addition to the operation of the switch controller 101 shown in FIG. 2. The power supply switch 202 is connected between a power supply node and the operational amplifier 104 and receives control signal S202. The power supply switch 202 is ON when control signal S202 is "H-level" but OFF when control signal S202 is "L-level".

Operation

Figure 5:
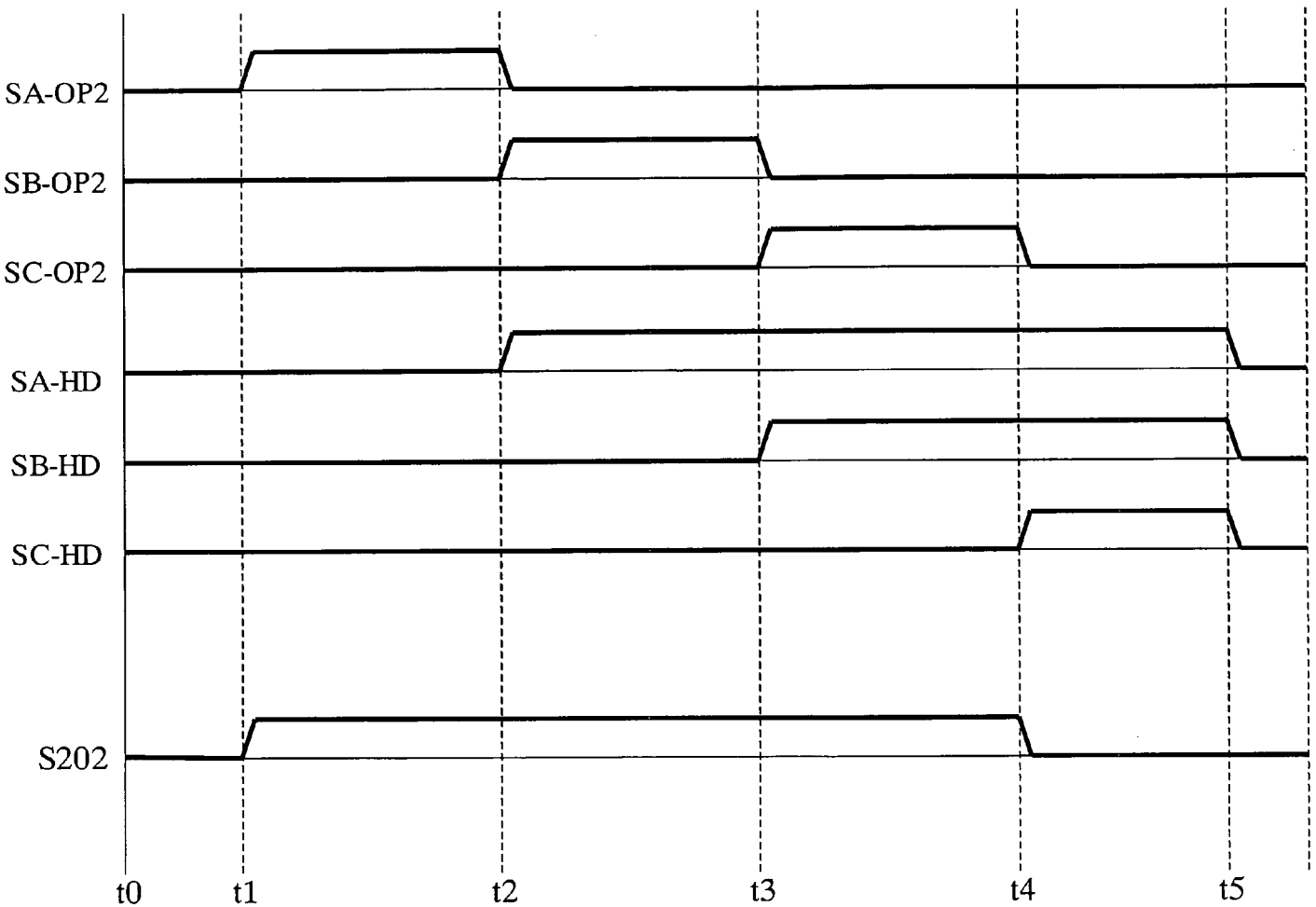
FIG. 5 is a timing chart which illustrates the operation of a liquid crystal driver shown in FIG. 4.

Next, the operation of the liquid crystal driver 22 shown in FIG. 4 is described with reference to FIG. 5. This driver controls the driving of the operational amplifier 104 in addition to the operation of the liquid crystal driver 12 shown in FIG. 2.

At time t1, the switch controller 201 sets control signal S202 to "H-level". Accordingly, the power from the power supply node is supplied to the operational amplifier 104 so that the operational amplifier 104 enters a driven state. Also, the switch controller 201 turns on the op-amp switches 105A-1 and 105A-2 as does the switch controller 101. As a result, drive voltage Va output from the selector 103A is supplied to the source line LineS-A via the operational amplifier 104.

During the interval between time t2 and time t4, the switch controller 201 sets control signal S202 to "H-level". Accordingly, the operational amplifier 104 maintains the driven state. Meanwhile, the switch controller 201 carries out the same operation as the switch controller 101 does. Therefore, the operational amplifier 104 amplifies drive voltage Vb output from the selector 103B (drive voltage Vc output from the selector 103C) and supplies amplified drive voltage Vb (Vc) to the source line LineS-B (LineS-C). Then, in all of the source lines LineS-A, LineS-B and LineS-C, writing of drive voltages Va, Vb and Vc is completed.

At time t4, the switch controller 201 sets control signals SC-OP1 and SC-OP2 to "L-level" as does the switch controller 101. Accordingly, control signals SA-OP1, SA-OP2, SB-OP1, SB-OP2, SC-OP1, SC-OP2 output from the switch controller 201 are all "L-level". Therefore, the operational amplifier 104 is not connected to any of the source lines LineS-A, LineS-B and LineS-C (the selectors 103A, 103B and 103C). Meanwhile, the switch controller 201 sets control signal S202 to "L-level". Thus, the power supply to the operational amplifier 104 is interrupted so that the operational amplifier 104 is halted.

Effects

As described above, when amplification of the voltage by the operational amplifier 104 is necessary (i.e., before completion of writing of drive voltage Va (Vb, Vc)), the operational amplifier 104 is driven. When amplification of the voltage by the operational amplifier 104 is not necessary (i.e., after completion of writing of drive voltage Va (Vb, Vc)), the operational amplifier 104 is halted. With such a feature, wasteful power consumption by the operational amplifier 104 is prevented. Hence, the power consumption by the liquid crystal driver 22 is reduced.

Embodiment 3

As the time between the writing of voltage $V_{LineS-A}$ of the source line in the pixel cell PA1 via the source line LineS-A and the turning-off of the gate line which causes the pixel cell PA1 to enter the retained state is longer, the possibility of effects by fluctuations in voltage on the source line is higher. For example, if writing in the source line LineS-A is completed prior to completion of writing in the source line LineS-B, there is a possibility that the fluctuations in voltage on the source line LineS-A are larger than the fluctuations in voltage on the source line LineS-B. (Namely, the fluctuations in voltages on the respective source lines are not uniform). In this case, an image reproduced on the liquid crystal display panel 10 mixedly includes high display quality regions and low display quality regions, so that the display quality is not uniform across the liquid crystal display panel 10.

In view of such, the period between completion of writing of drive voltage Va in the source line LineS-A and the turning-off of the gate line which causes the pixel cell PA1 to enter the retained state (transition period A), the period between completion of writing of drive voltage Vb in the source line LineS-B and the turning-off of the gate line which causes the pixel cell PB1 to enter the retained state (transition period B), and the period between completion of writing of drive voltage Vc in the source line LineS-C and the turning-off of the gate line which causes the pixel cell PC1 to enter the retained state (transition period C) are desirably uniform (i.e., have an equal length).

Structure

A liquid crystal display device according to embodiment 3 of the present invention has the same structure as that shown in FIG. 1 and FIG. 2. According to this embodiment, the switch controller 101 allocates the operational amplifier 104 to the source lines LineS-A, LineS-B and LineS-C in a time-division manner. Namely, writing of the drive voltages in the source lines LineS-A, LineS-B and LineS-C is carried out in a time-division manner.

Operation

Figure 6:
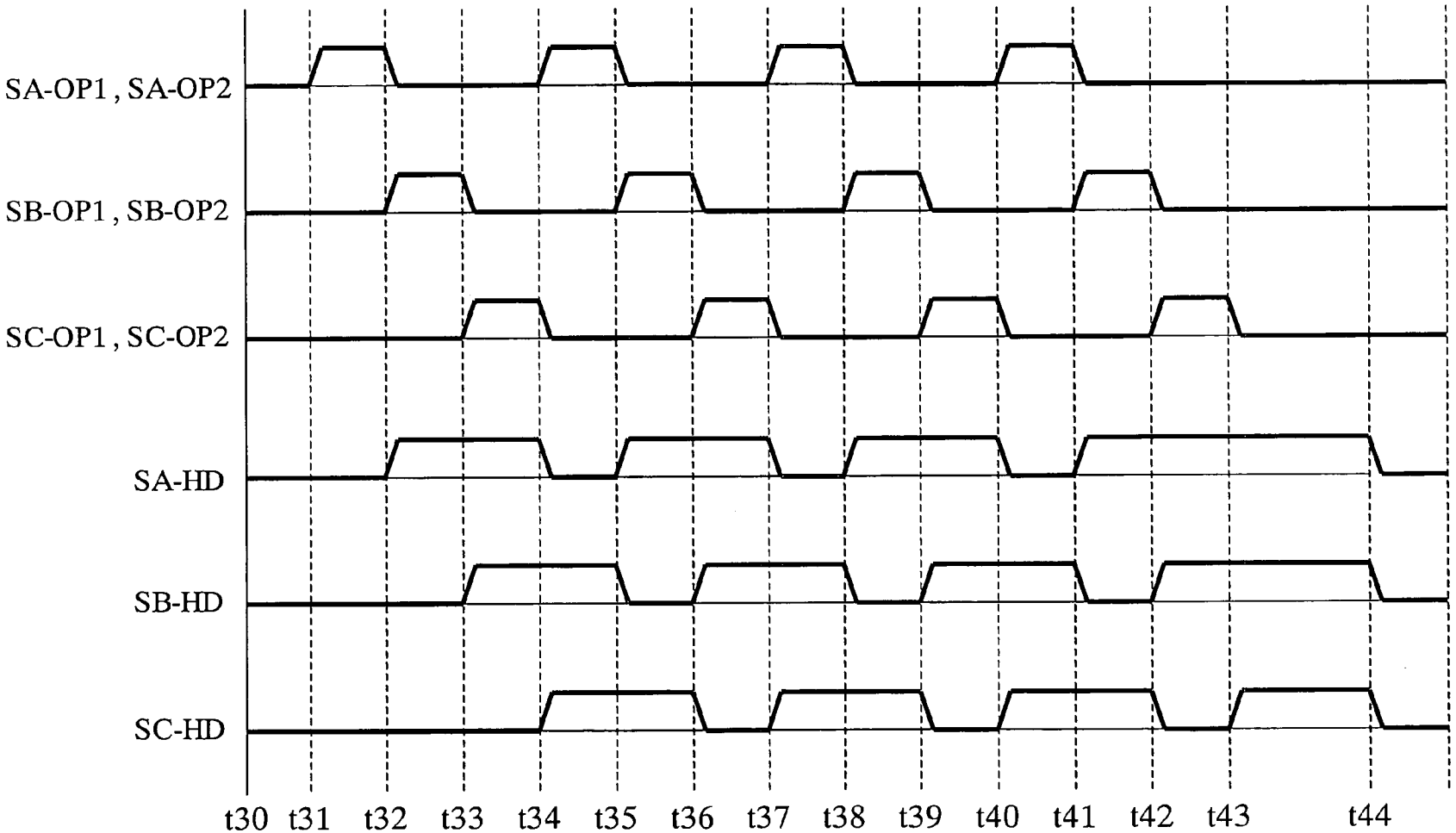
FIG. 6 is a timing chart which illustrates the operation of a liquid crystal driver according to embodiment 3 of the present invention.

Next, the operation of the liquid crystal driver 12 of this embodiment is described with reference to FIG. 6.

At time t31, the switch controller 101 sets control signals SA-OP1 and SA-OP2 to "H-level". Accordingly, drive voltage Va output from the selector 103A is supplied to the source line LineS-A via the operational amplifier 104.

At time t32, the switch controller 101 sets control signals SA-OP1 and SA-OP2 to "L-level" and control signal SA-HD to "H-level". Accordingly, drive voltage Va output from the selector 103A is supplied to the source line LineS-A via the voltage retention switch 106A. Meanwhile, the switch controller 101 sets control signals SB-OP1 and SB-OP2 to "H-level". Accordingly, drive voltage Vb output from the selector 103B is supplied to the source line LineS-B via the operational amplifier 104.

At time t33, the switch controller 101 sets control signals SB-OP1 and SB-OP2 to "L-level" and control signal SB-HD to "H-level". Accordingly, drive voltage Vb output from the selector 103B is supplied to the source line LineS-B via the voltage retention switch 106B. Meanwhile, the switch controller 101 sets control signals SC-OP1 and SC-OP2 to "H-level". Accordingly, drive voltage Vc output from the selector 103C is supplied to the source line LineS-C via the operational amplifier 104.

At time t34, the switch controller 101 sets control signals SC-OP1 and SC-OP2 to "L-level" and control signal SC-HD to "H-level". Accordingly, drive voltage Vc output from the selector 103C is supplied to the source line LineS-C via the voltage retention switch 106C. Meanwhile, the switch controller 101 sets control signals SA-OP1 and SA-OP2 to "H-level". Accordingly, drive voltage Va output from the selector 103A is supplied to the source line LineS-A via the operational amplifier 104.

Thereafter, at time t35 and time t38, the same operation carried out at time t32 is performed. At time t36 and time t39, the same operation carried out at time t33 is performed. At time t37 and time t40, the same operation carried out at time t34 is performed.

Then, at time t41, the switch controller 101 performs the same operation as that carried out at time t32. Accordingly, drive voltage Va output from the selector 103A is supplied to the source line LineS-A via the voltage retention switch 106A, and drive voltage Vb output from the selector 103B is supplied to the source line LineS-B via the operational amplifier 104.

Then, at time t42, the switch controller 101 performs the same operation as that carried out at time t33. Accordingly, drive voltage Vb output from the selector 103B is supplied to the source line LineS-B via the voltage retention switch 106B, and drive voltage Vc output from the selector 103C is supplied to the source line LineS-C via the operational amplifier 104.

At time t43, the switch controller 101 sets control signals SC-OP1 and SC-OP2 to "L-level" and control signal SC-HD to "H-level". Accordingly, drive voltage Vc output from the selector 103C is supplied to the source line LineS-C via the voltage retention switch 106C.

At time t44, the switch controller 101 sets control signals SA-HD, SB-HD and SC-HD to "L-level". Meanwhile, the gate driver 13 stops outputting the scan signal to the gate line LineG-1. Accordingly, voltage $V_{LineS\text{-}A}$ written in the pixel cell PA1 via the source line LineS-A is retained. Also, voltage $V_{LineS\text{-}B}$ ($V_{LineS\text{-}C}$) of the source line LineS-B (LineS-C) is retained in the pixel cell PB1 (PC1) as in the pixel cell PA1.

In such a way, writing of drive voltage Va (Vb, Vc) in the source line LineS-A (LineS-B, LineS-C) is carried out in separate cycles. With this feature, the periods between the completion of writing of the drive voltages in respective one of the source lines LineS-A, LineS-B and LineS-C and the turning-off of the gate lines which causes the pixel cells PA1 to PC1 to enter the retained state have substantially equal length.

Effects

As described above, the write completion times for the source lines LineS-A, LineS-B and LineS-C are substantially identical, so that transition period A, transition period B and transition period C have substantially the same length. Therefore, fluctuations in voltage on the source line LineS-A, fluctuations in voltage on the source line LineS-B, and fluctuations in voltage on the source line LineS-C are substantially uniform. As a result, uniform display quality is achieved across the liquid crystal display panel 10.

The times spent till the voltage values of the voltages of the source lines LineS-A, LineS-B and LineS-C reach drive voltages Va, Vb and Vc (achievement rate) are uniform. Thus, writing of the drive voltages in the source lines LineS-A, LineS-B and LineS-C appear to occur simultaneously.

In this embodiment, the writing of the drive voltage in one source line is divided into four cycles. However, it is not limited to four cycles but may be five or more cycles.

Embodiment 4

Structure

Figure 7:
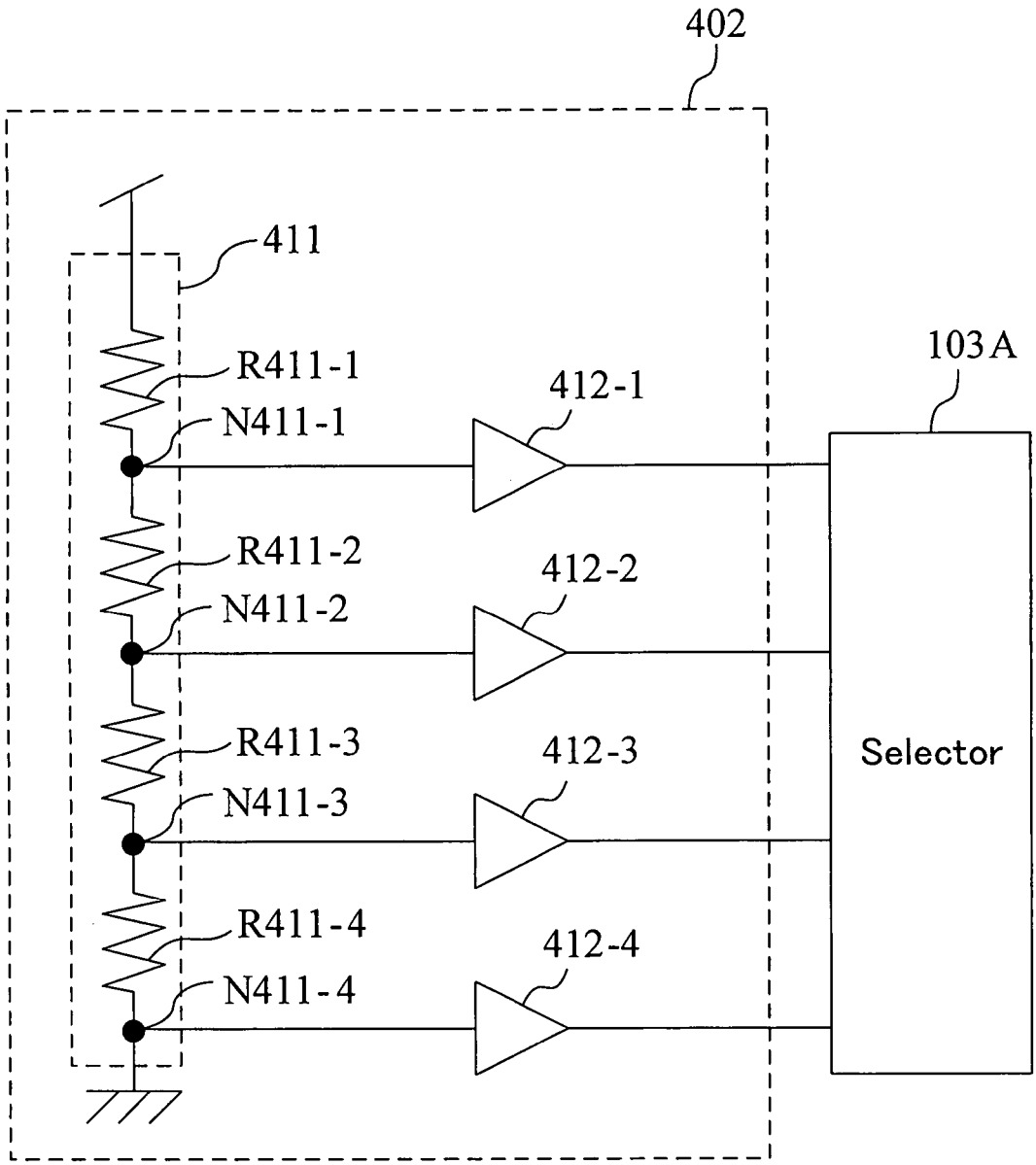
FIG. 7 shows an internal structure of a gray level voltage generator according to embodiment 4 of the present invention.

A liquid crystal display device according to embodiment 4 of the present invention includes a gray level voltage generator 402 shown in FIG. 7 in place of the gray level voltage generator 102 shown in FIG. 2. The other components are the same as those shown in FIG. 1 and FIG. 2.

Internal Structure of Gray Level Voltage Generator

FIG. 7 shows the internal structure of the gray level voltage generator 402 according to this embodiment. The gray level voltage generator 402 includes a ladder resistor 411 (resistors R411-1 to R411-4) and operational amplifiers 412-1 to 412-4. The resistors R411-1 to R411-4 are connected in series between a power supply node and a ground node. The operational amplifier 412-1 is connected between a node N411-1 of the ladder resistor 411 (the interconnection node of the resistor R411-1 and the resistor R411-2) and the selector 103A. The operational amplifier 412-2 is connected between a node N411-2 of the ladder resistor 411 (the interconnection node of the resistor R411-2 and the resistor R411-3) and the selector 103A. The operational amplifier 412-3 is connected between a node N411-3 of the ladder resistor 411 (the interconnection node of the resistor R411-3 and the resistor R411-4) and the selector 103A. The operational amplifier 412-4 is connected between a node N411-4 of the ladder resistor 411 (the interconnection node of the resistor R411-4 and the ground node) and the selector 103A.

It should be noted that the connections between the gray level voltage generator 402 and the selector 103B and the connections between the gray level voltage generator 402 and the selector 103C are the same as those between the gray level voltage generator 402 and the selector 103A shown in FIG. 7.

It should be noted that FIG. 7 shows an example where the number of outputs of the gray level voltage generator 402 is "4" ("N=4").

Operation

Next, the operation of the gray level voltage generator 402 shown in FIG. 7 is described.

The resistors R411-1 to R411-4 divide the voltage between the power supply node and the ground node such that four gray level voltages having different voltage values are respectively generated at the nodes N411-1 to N411-4.

Then, the operational amplifier 412-1 amplifies the gray level voltage generated at the node N411-1 of the ladder resistor 411 and supplies the amplified gray level voltage to the selector 103A (selector 103B, 103C). The operational amplifiers 412-2 to 412-4 also amplify the gray level voltages generated at the nodes N411-2 to N411-4 of the ladder resistor 411 and supply the amplified gray level voltages to the selector 103A (selector 103B, 103C) as the operational amplifier 412-1 does.

In such a way, the gray level voltages generated by the ladder resistor 411 (resistors R411-1 to R411-4) are amplified by the operational amplifiers 412-1 to 412-4 and then respectively supplied to the selectors 103A to 103C.

Effects

As described above, the gray level voltages from the gray level voltage generator 402 are amplified such that the gray level voltage supplied to the source line LineS-A (LineS-B, LineS-C) via the voltage retention switch 106A (106B, 106C) has low impedance. With this feature, fluctuations in voltage in each of the source lines LineS-A, LineS-B and LineS-C is further suppressed.

Embodiment 5

Structure

Figure 8:
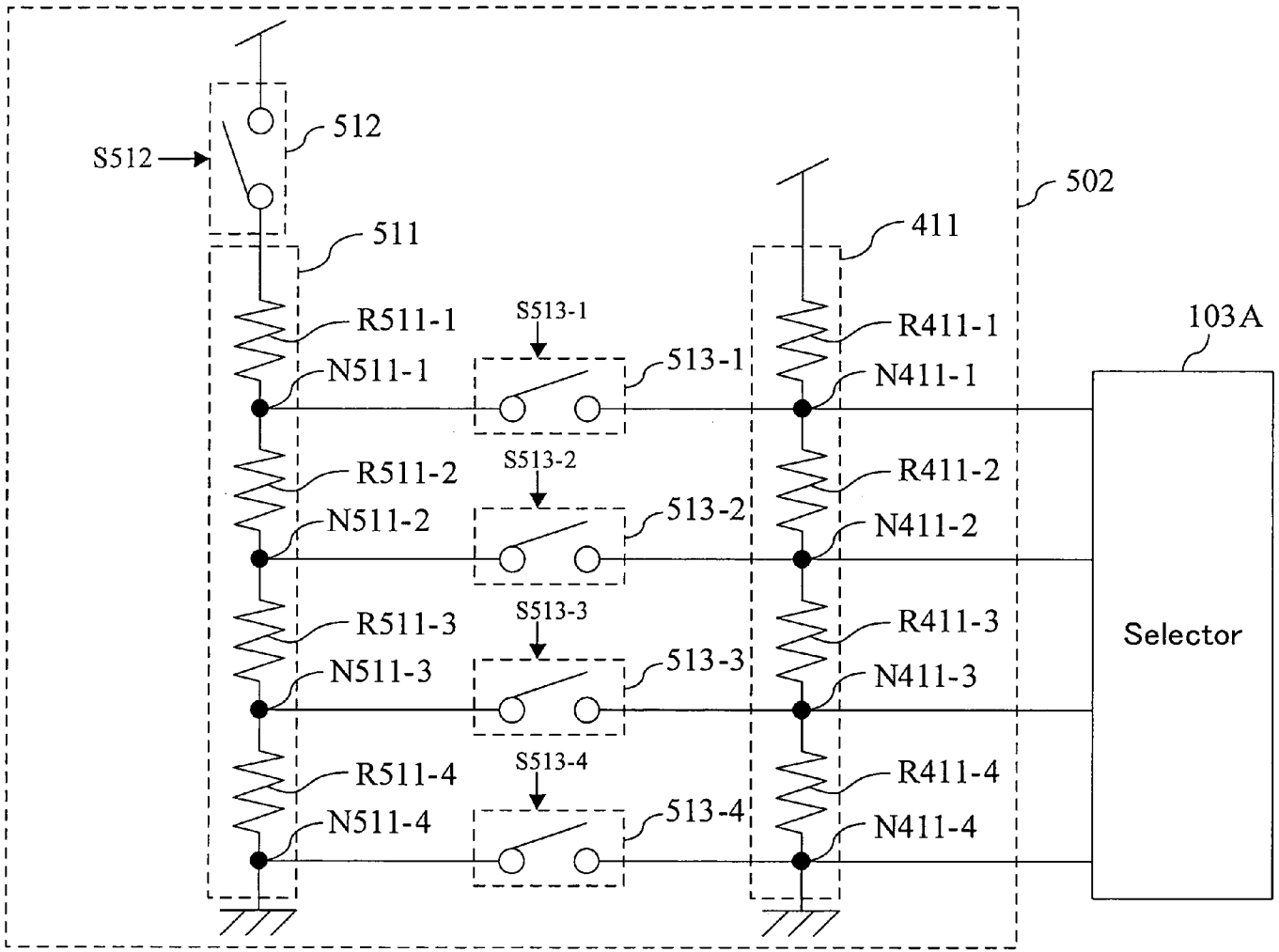
FIG. 8 shows an internal structure of a gray level voltage generator according to embodiment 5 of the present invention.

A liquid crystal display device according to embodiment 5 of the present invention includes a gray level voltage generator 502 shown in FIG. 8 in place of the gray level voltage generator 102 shown in FIG. 2. The switch controller 101 outputs control signals S512 and S513-1 to S513-4 according to predetermined timings. The other components are the same as those shown in FIG. 1 and FIG. 2.

Gray Level Voltage Generator

The gray level voltage generator 502 includes a ladder resistor 511 (resistors R511-1 to R511-4), a power supply switch 512, and connection switches 513-1 to 513-4 in place of the operational amplifiers 412-1 to 412-4 shown in FIG. 7.

The power supply switch 512 and the resistors R511-1 to R511-4 are connected in series between the power supply node and the ground node. The power supply switch 512 is connected between the power supply node and the resistor R511-1 and receives control signal S512. The connection switch 513-1 is connected between the node N411-1 of the ladder resistor 411 and the node N511-1 of the ladder resistor 511 (the interconnection node of the resistor R511-1 and the resistor R511-2) and receives control signal S513-1. The connection switch 513-2 is connected between the node N411-2 of the ladder resistor 411 and the node N511-2 of the ladder resistor 511 (the interconnection node of the resistor R511-2 and the resistor R511-3) and receives control signal S513-2. The connection switch 513-3 is connected between the node N411-3 of the ladder resistor 411 and the node N511-3 of the ladder resistor 511 (the interconnection node of the resistor R511-3 and the resistor R511-4) and receives control signal S513-3. The connection switch 513-4 is connected between the node N411-4 of the ladder resistor 411 and the node N511-4 of the ladder resistor 511 (the interconnection node of the resistor R511-4 and the ground node) and receives control signal S513-4.

The power supply switch 512 is ON when control signal S512 is "H-level" but OFF when control signal S512 is "L-level". The connection switches 513-1 to 513-4 are ON when corresponding control signals S513-1 to S513-4 are "H-level" but OFF when control signals S513-1 to S513-4 are "L-level".

Operation

Figure 9:
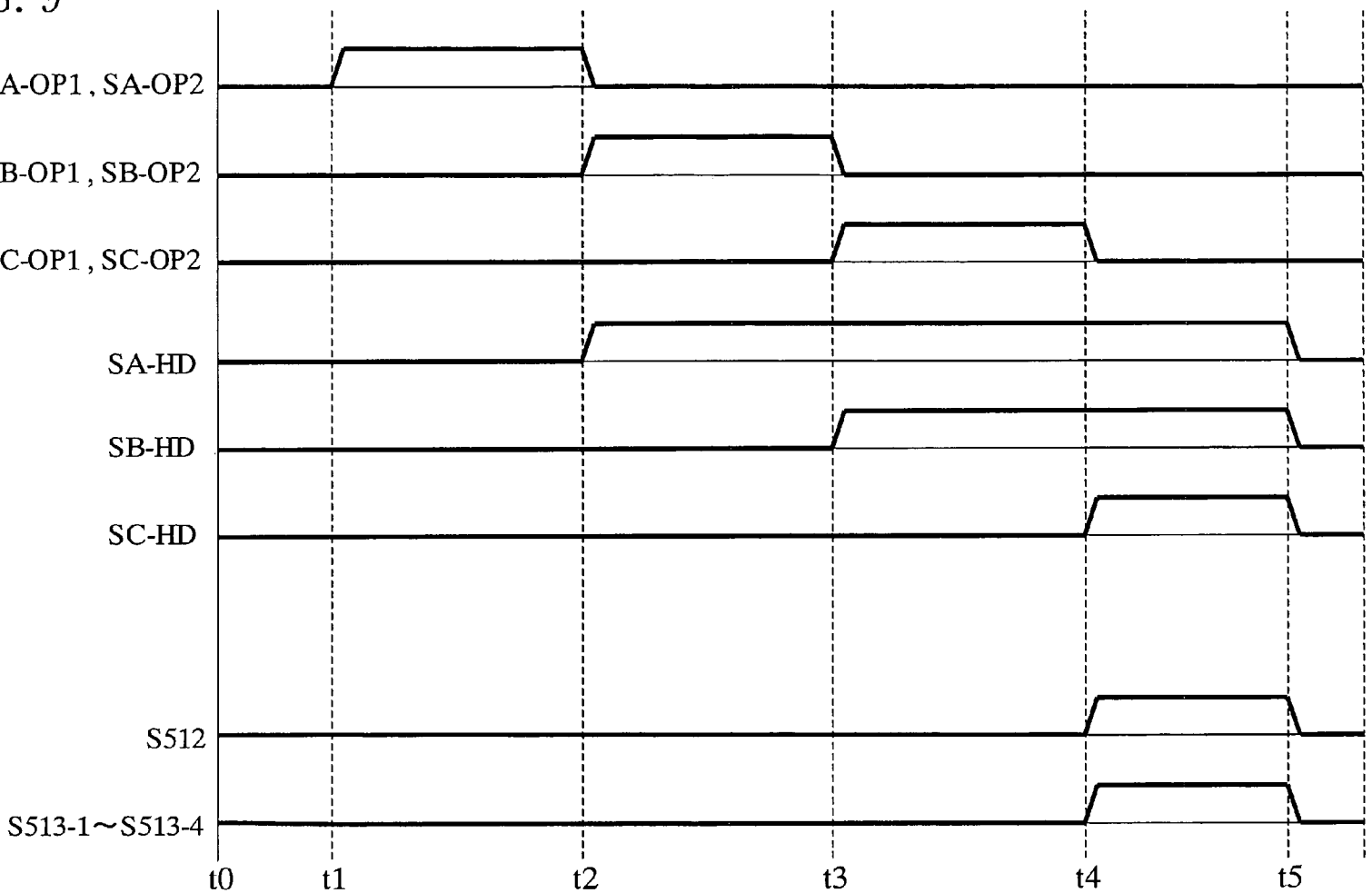
FIG. 9 is a timing chart which illustrates the operation of a liquid crystal driver according to embodiment 5 of the present invention.
Figure 10:
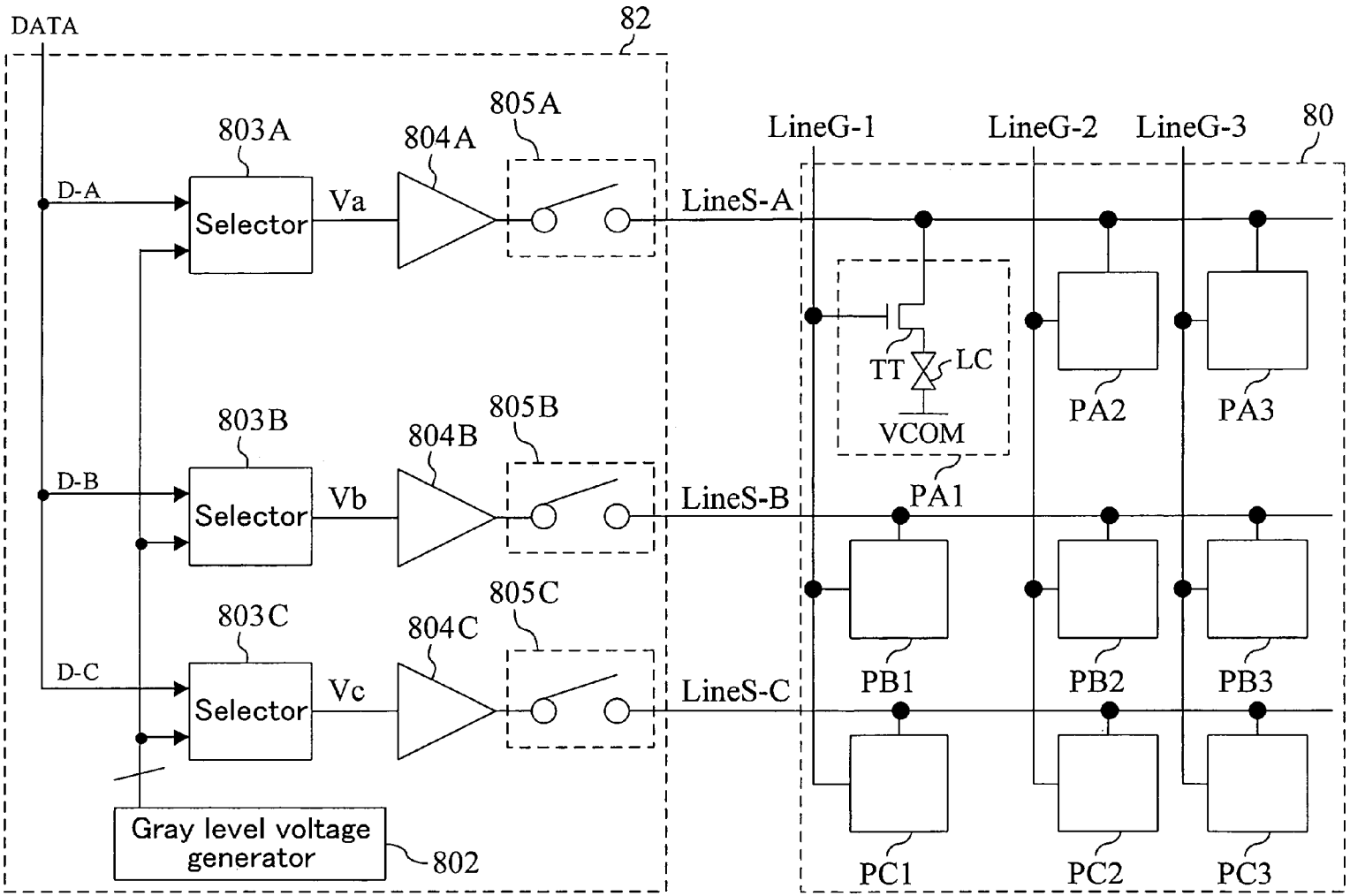
FIG. 10 shows a general structure of a conventional liquid crystal driver.
Figure 11:
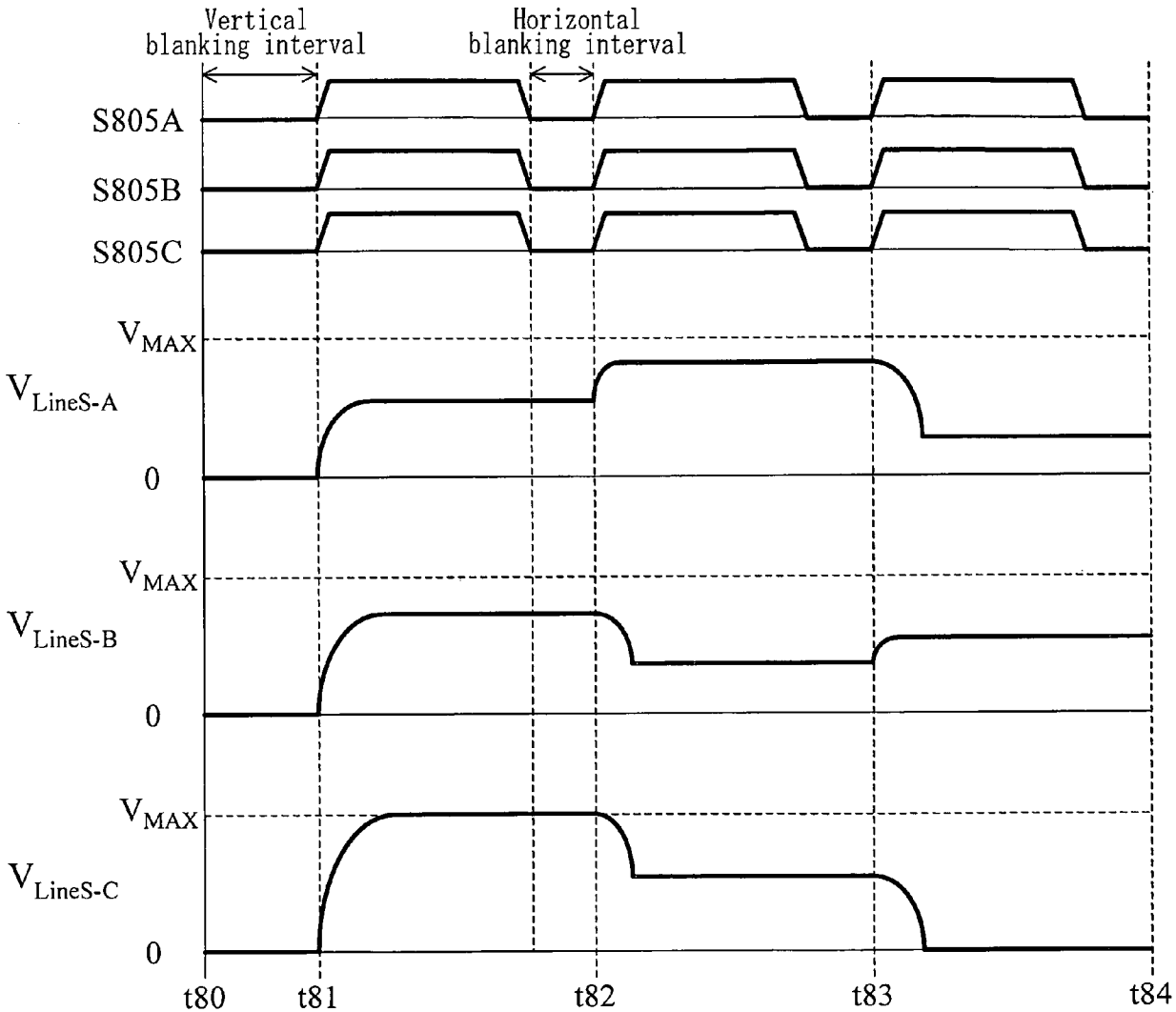
FIG. 11 is a timing chart which illustrates the operation of a liquid crystal driver shown in FIG. 10.
Figure 12:
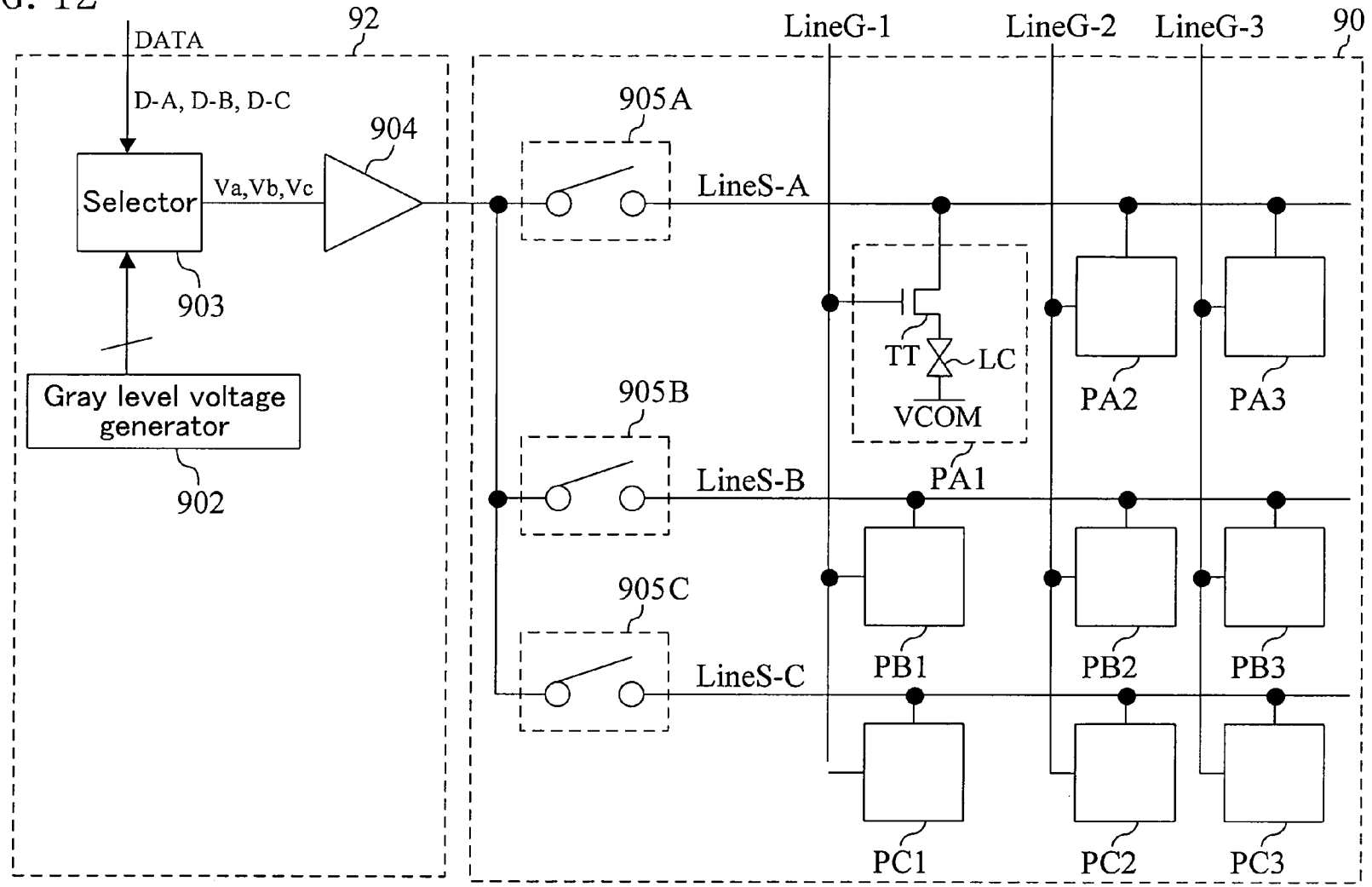
FIG. 12 shows a general structure of another conventional liquid crystal driver.

Next, the operation of the gray level voltage generator 502 shown in FIG. 8 is described with reference to FIG. 9.

During the interval between time t0 and time t4, the switch controller 101 sets control signals S512 and S513-1 to S513-4 to "L-level". Meanwhile, the switch controller 101 uses, as in embodiment 1, the operational amplifier 104 to write the drive voltages in the source lines LineS-A, LineS-B and LineS-C and uses the voltage retention switches 106A and 106B to retain the drive voltages.

At time t4, the switch controller 101 sets, as in embodiment 1, control signals SC-OP1 and SC-OP2 to "L-level". Accordingly, control signals SA-HD, SB-HD and SC-HD output from the switch controller 201 are all "H-level", so that the selector 103A is connected to the source line LineS-A via the voltage retention switch 106A, the selector 103B is connected to the source line LineS-B via the voltage retention switch 106B, and the selector 103C is connected to the source line LineS-C via the voltage retention switch 106C. Meanwhile, the switch controller 101 sets control signals S513-1 to S513-4 to "H-level" so that the nodes N511-1 to N511-4 of the ladder resistor 511 are connected to the nodes N411-1 to N411-4, of the ladder resistor 411. Meanwhile, the switch controller 101 sets control signal S512 to "H-level" so that the currents flowing through the nodes N411-1 to N411-4 of the ladder resistor 411 become larger. Therefore, the impedance of the gray level voltages output from the gray level voltage generator 502 becomes lower.

As described above, when the selector 103A (103B, 103C) is connected to the source line LineS-A (LineS-B, LineS-C) via the voltage retention switch 106A (106B, 106C), the impedance of the gray level voltages supplied from the gray level voltage generator 502 to the selector 103A (103B, 103C) becomes lower.

Effects

As described above, when drive voltage Va (Vb, Vc) written in the source line LineS-A (LineS-B, LineS-C) is retained, the current supplied to each of the source lines LineS-A, LineS-B and LineS-C increases (the impedance of drive voltage Va (Vb, Vc) supplied from the selector 103A (103B, 103C) becomes lower). With this feature, fluctuations in voltage on each of the source lines LineS-A, LineS-B and LineS-C are further suppressed.

It should be noted that in the descriptions of the above embodiments the liquid crystal display panel is provided with three source lines and three gate lines, but the source and gate lines are not limited to these numbers. For example, the liquid crystal display panel may be provided with four or more source lines or four or more gate lines. The number of source lines and the number of gate lines may be any numbers so long as one source line is provided with a selector (selector equivalent to the selector 103A), op-amp switches (switches equivalent to the op-amp switches 105A-1 and 105A-2), and a voltage retention switch (switch equivalent to the voltage retention switch 106A).

The number of source lines allocated to one operational amplifier is not limited to three but may be four or more. In an example where a pixel of the liquid crystal display panel consists of three pixel cells (pixel cell R corresponding to R (red) component of the pixel, pixel cell G corresponding to G (green) component of the pixel, and pixel cell B corresponding to B (blue) component of the pixel), an R source line (source line connected to pixel cell R), a G source line (source line connected to pixel cell G), and a B source line (source line connected to pixel cell B) may be allocated to one operational amplifier.

It should be noted that the timing when the switch controller 101 sets the control signal to "H-level" (or "L-level") may be set arbitrarily. For example, by setting the timing according to the type or size of the liquid crystal display panel or the frame cycle of display data DATA, writing of the drive voltages in the source lines LineS-A, LineS-B and LineS-C are smoothly carried out.

Some of the above descriptions are presented with an example of an amorphous TFT, but the switching element used in the liquid crystal display panels of the present invention is not limited to the amorphous TFT.

INDUSTRIAL APPLICABILITY

As described above, the present invention enables reduction of the circuit scale and suppression of fluctuations in voltages on the source lines and is therefore useful for a liquid crystal display device, etc.

The invention claimed is:

1. A liquid crystal driver for driving a liquid crystal display panel which includes P source lines, P being a natural number, the driver comprising:

a gray level voltage generator for generating N gray level voltages which have different voltage values from one another, N being a natural number;

an operational amplifier for amplifying an input voltage;

P selectors corresponding to the P source lines;

P connection switching sections corresponding to the P selectors and disposed between the P selectors and the P source lines; and a controller for controlling the P connection switching sections, wherein:

each of the P selectors receives pixel data indicative of a gray level to select one of the N gray level voltages generated by the gray level voltage generator which corresponds to the pixel data and outputs the selected gray level voltage, each of the P connection switching sections has a voltage write mode and a voltage retention mode, in the voltage write mode, each of the connection switching sections supplies an output of a corresponding one of the P selectors to the operational amplifier and supplies an output of the operational amplifier to a corresponding one of the P source lines, in the voltage retention mode, each of the connection switching sections supplies an output of a corresponding one of the P selectors to a corresponding one of the P source lines, and the controller is configured to:

set each of the P connection switching sections into the voltage write mode at least once;

for each of the P connection switching sections set into the voltage write mode, after passage of a first predetermined interval, shift said each of the P connection switching sections from the voltage write mode to the voltage retention mode; and after all of the P connection switching sections have been set to the voltage write mode at least once and shifted to the voltage retention mode, maintain all of the P connection switching sections in the voltage retention mode until a second predetermined interval passes.

2. The liquid crystal driver of claim 1, wherein the controller carries out the mode shift in each of the P connection switching sections more than once during the second predetermined interval.

3. The liquid crystal driver of claim 1, further comprising a power controller, wherein if any one of the P connection switching sections is in the voltage write mode, the power controller supplies power to the operational amplifier, and if all of the P connection switching sections are in the voltage retention mode, the power controller interrupts supply of power to the operational amplifier.

4. The liquid crystal driver of claim 1, wherein the gray level voltage generator includes:

a ladder resistor connected between a first reference node and a second reference node, the ladder resistor including N taps; and N amplification operational amplifiers corresponding to the N taps of the ladder resistor, wherein each of the N amplification operational amplifiers is connected between a corresponding one of the N taps and each of the P selectors.

5. The liquid crystal driver of claim 1, wherein the gray level voltage generator includes:

a first ladder resistor connected between a first reference node and a second reference node, the first ladder resistor including N first taps;

a second ladder resistor connected between a third reference node and a fourth reference node, the second ladder resistor including N second taps; and a ladder resistor connector for connecting, if all of the P connection switching sections are in the voltage retention mode, the N first taps of the first ladder resistor and the N second taps of the second ladder resistor on a one-to-one basis.

6. The liquid crystal driver of claim 5, wherein the gray level voltage generator further includes a power controller, wherein if any one of the P connection switching sections is in the voltage write mode, the power controller supplies power to the second ladder resistor, and if all of the P connection switching sections are in the voltage retention mode, the power controller interrupts supply of the power to the second ladder resistor.

7. A liquid crystal display device, comprising:

the liquid crystal driver of claim 1;

a liquid crystal display panel including the P source lines, Q gate lines, Q being a natural number, and P×Q pixel cells; and a gate driver for driving the Q gate lines, wherein each of the P×Q pixel cells includes a switching element and a liquid crystal element.

8. The liquid crystal driver of claim 1, wherein the P connection switching sections are sequentially set into the voltage write mode.

9. The liquid crystal driver of claim 8, wherein more than one of the P connection switching sections are not simultaneously set into the voltage write mode.

10. The liquid crystal driver of claim 1, wherein one operational amplifier as the operational amplifier is provide for all of the P selectors, and said one operation amplifier supplies the output to the P source lines.

11. A liquid crystal driver for driving a liquid crystal display panel which includes P source lines, P being a natural number, the driver comprising:

a gray level voltage generator for generating N gray level voltages which have different voltage values from one another, N being a natural number;

an operational amplifier for amplifying an input voltage;

P selectors corresponding to the P source lines;

P first switches corresponding to the P selectors;

P second switches corresponding to the P source lines;

P third switches corresponding to the P selectors; and a controller for controlling the P first, second and third switches, wherein:

each of the P selectors receives pixel data indicative of a gray level to select one of the N gray level voltages generated by the gray level voltage generator which corresponds to the pixel data and outputs the selected gray level voltage, each of the P first switches is connected between a corresponding one of the P selectors and the operational amplifier, each of the P second switches is connected between a corresponding one of the P source lines and the operational amplifier, each of the P third switches is connected between a corresponding one of the P selectors and a corresponding one of the P source lines, and the controller is configured to during an operation interval:

turn each pair of the first and second P switches ON at least once;

for each pair of the first and second P switches turned ON, after passage of a predetermined interval, turn said each pair of the first and second P switches OFF and turn a corresponding one of the third P switches ON; and after all of the third P switches have been turned ON, maintains all of the first and second P switches OFF and all of the third P switches ON until a predetermined timing.

12. The liquid crystal driver of claim 11, wherein pairs of the first and second P switches are sequentially set into the voltage write mode.

13. The liquid crystal driver of claim 12, wherein more than one pair of the first and second switches are not simultaneously set into the voltage write mode.

14. A method for driving a liquid crystal display panel which includes P source lines and corresponding P connection switching sections, P being a natural number, the method comprising the steps of:

(A) generating N gray level voltages which have different voltage values from one another, N being a natural number;

(B) receiving pixel data indicative of a gray level to select one of the N gray level voltages generated at step (A) which corresponds to the pixel data;

(C) amplifying the gray level voltage selected at step (B) to supply the amplified gray level voltage to the P source lines; and (D) after step (C), supplying the gray level voltage selected at step (B) to the P source lines, wherein:

the steps (C) and (D) further includes, during an operation interval:

setting each of the P connection switching sections into a voltage write mode at least once to supply the amplified gray level voltage corresponding to said each of the P connection switching sections to be set into the voltage write mode;

for each of the P connection switching sections set into the voltage write mode, after passage of a first predetermined interval, shifting said each of the P connection switching sections from the voltage write mode to a voltage retention mode; and after all of the P connection switching sections have been set to the voltage write mode at least once and shifted to the voltage retention mode, maintaining all of the P connection switching sections in the voltage retention mode until a second predetermined interval passes.

15. The method of claim 14, wherein the P connection switching sections are sequentially set into the voltage write mode.

16. The method of claim 15, wherein more than one of the P connection switching sections are not simultaneously set into the voltage write mode.

* * * * *